US010347958B2

(12) United States Patent
Nita et al.

(10) Patent No.: US 10,347,958 B2
(45) Date of Patent: Jul. 9, 2019

(54) COAXIAL FILTER HAVING A FRAME CONSTRUCTION AND A CONDUCTIVE SEPARATING WEB, WHERE INTERNAL RESONATORS CAN BE GALVANICALLY CONNECTED TO EITHER THE FRAME CONSTRUCTION OR THE SEPARATING WEB

(71) Applicant: KATHREIN-WERKE KG, Rosenheim (DE)

(72) Inventors: Jens Nita, Rosenheim (DE); Franz Rottmoser, Schechen (DE)

(73) Assignee: Kathrein SE, Rosenheim (DE)

( * ) Notice: Subject to any disclaimer, the term of this patent is extended or adjusted under 35 U.S.C. 154(b) by 0 days.

(21) Appl. No.: 15/455,913

(22) Filed: Mar. 10, 2017

(65) Prior Publication Data

US 2017/0263992 A1 Sep. 14, 2017

(30) Foreign Application Priority Data

Mar. 14, 2016 (DE) ..... 10 2016 104 608

(51) Int. Cl.
*H01P 1/205* (2006.01)
*H01P 1/202* (2006.01)
*H01P 5/02* (2006.01)

(52) U.S. Cl.
CPC ..... *H01P 1/2053* (2013.01); *H01P 1/202* (2013.01); *H01P 1/205* (2013.01); *H01P 5/02* (2013.01)

(58) Field of Classification Search
CPC ..... H01P 1/2053; H01P 1/205; H01P 7/04
USPC ..... 333/203
See application file for complete search history.

(56) References Cited

U.S. PATENT DOCUMENTS 3,534,244 A * 10/1970 Brounley ..... H01P 1/205 333/218
3,597,709 A * 8/1971 Rhodes ..... H01P 1/205 333/203
4,660,004 A * 4/1987 Jachowski ..... H01P 1/2136 331/134

(Continued)

FOREIGN PATENT DOCUMENTS

CN 102361115 7/2014
DE 10 2004 010 683 9/2005

(Continued)

OTHER PUBLICATIONS

European Search Report dated Jul. 5, 2017, issued in European Patent Application No. 17160113.1.

*Primary Examiner* — Benny T Lee
(74) *Attorney, Agent, or Firm* — Nixon & Vanderhye P.C.

(57) ABSTRACT

A coaxial filter having a frame construction comprises at least one filter frame, which consists of an electrically conductive medium and comprises a receiving space. A cover arrangement closes the receiving space on all sides. At least one first resonator internal conductor is arranged in the receiving space. The at least one first resonator internal conductor is galvanically connected to a face of the at least one electrically conductive filter frame, and extends therefrom in the direction of another, in particular opposing face of the electrically conductive filter frame, and ends at a distance from the opposing face of the electrically conductive filter frame and/or is galvanically separated from the opposing face of the electrically conductive filter frame.

20 Claims, 18 Drawing Sheets

(56) References Cited

U.S. PATENT DOCUMENTS

| | | | | |
|---|---|---|---|---|
| 4,890,078 | A * | 12/1989 | Radcliffe | H01P 1/2138 333/134 |
| 5,262,742 | A | 11/1993 | Bentivenga | |
| 5,352,996 | A * | 10/1994 | Kawaguchi | H01P 1/20345 29/600 |
| 5,446,729 | A * | 8/1995 | Jachowski | H01P 1/2136 333/1 |
| 8,884,722 | B2 | 11/2014 | Mohajer-Iravani et al. | |
| 2008/0122559 | A1 | 5/2008 | Hoft et al. | |
| 2015/0091672 | A1* | 4/2015 | Subedi et al. | H01P 1/205 333/203 |

FOREIGN PATENT DOCUMENTS

| | | |
|---|---|---|
| EP | 2 800 201 | 11/2014 |
| JP | 58-172001 A | 10/1983 |
| JP | 3385909 B2 | 3/2003 |
| JP | 5341121 B2 | 11/2013 |

* cited by examiner

COAXIAL FILTER HAVING A FRAME CONSTRUCTION AND A CONDUCTIVE SEPARATING WEB, WHERE INTERNAL RESONATORS CAN BE GALVANICALLY CONNECTED TO EITHER THE FRAME CONSTRUCTION OR THE SEPARATING WEB

CROSS-REFERENCE TO RELATED APPLICATIONS

This application claims priority to German Patent Application No. 10 2016 104 608.6 filed Mar. 14, 2016. The disclosure of the prior application is incorporated herein in its entirety by reference.

STATEMENT REGARDING FEDERALLY SPONSORED RESEARCH OR DEVELOPMENT

None.

FIELD

The invention relates to coaxial filters having a frame construction.

BACKGROUND AND SUMMARY

Filters are often used in telecommunications and high-frequency technology in contexts where only particular frequency components of a signal are to be processed further. As well as high-pass or low-pass filters, there are also band-pass or band-stop filters. Filters may be implemented digitally and may also be constructed using discrete components. The filters may be constructed on a conductor plate or be formed as coaxial filters in the form of milled or cast cavity structures. Filters of a coaxial construction are mostly produced in a pressure casting method, where fine tuning is possible by means of tuning elements which can additionally be screwed in.

A filter of this type is known for example from DE 10 2004 010 683 B3. However, a filter of this type has the drawback that the construction volume, in particular the height, is large. This leads to problems in some fields of application.

Therefore, the example technology herein provides a coaxial filter having a frame construction in which the ratio of power to construction volume is improved. It should also be possible to construct this filter in as simple and cost-effective a manner as possible.

The coaxial filter has a frame construction comprising at least one filter frame, which consists of an electrically conductive medium and has a receiving space, the receiving space being arranged inside the at least one electrically conductive filter frame. Further, a cover arrangement is provided, which is arranged on two opposing faces of the at least one filter frame, in such a way that the receiving pace is at least predominantly closed on all sides. Exceptions may occur for example in the region of the connection sockets. At least one first resonator internal conductor is arranged in the receiving space. The at least one first resonator internal conductor is galvanically connected to a face of the at least one electrically conductive filter frame, and extends therefrom in the direction of another, in particular opposing face of the electrically conductive filter frame, and ends at a distance from the opposing face of the electrically conductive filter frame and/or is galvanically separated from the opposing face of the electrically conductive filter frame.

It is particularly advantageous that the coaxial filter is constructed in a frame construction, resulting in a very low construction height being achieved. This means that it is possible to see through the high-frequency filter in a plan view thereof when the cover arrangement is removed. The coaxial filter can be produced by casting, in particular by (aluminium or zinc) (pressure) casting. A coaxial filter of this type may be used in particular for powers of 5 to 20 watts. The power may also be lower or higher. The filter frame is preferably formed integrally with the separating web and the resonator internal conductors. A construction in a plurality of parts could also be possible. The resonator internal conductors of the filter frame could also be produced from plastics material, which would thus have to be provided with an electrically conductive layer.

An example coaxial filter comprises at least one electrically conductive separating web, which originates on a first face of the at least one filter frame and is galvanically conductively connected to said frame, and protrudes into the receiving space, and extends in the direction of a second face of the at least one filter frame where it ends so as to form an opening therewith, causing the receiving space to be divided into at least one first and at least one second receiving chamber and the opening connecting the two receiving chambers. The at least one first resonator internal conductor is arranged in the at least one first receiving chamber of the receiving space. The at least one first resonator internal conductor is galvanically connected either to a third face of the at least one electrically conductive filter frame or to a first face of the electrically conductive separating web, and extends therefrom either in the direction of the separating web or in the direction of the filter frame, and ends at a distance from the separating web or filter frame and is galvanically separated therefrom. The same also applies to a second resonator internal conductor, which is arranged in the second receiving chamber of the receiving space.

The coaxial filter comprises in particular a first coupling-in and/or coupling-out device and/or at least a second coupling-in and/or coupling-out device, which, from the outside, preferably via the first face of the at least one filter frame, enters the first or second receiving chamber, where it establishes predominantly capacitive or predominantly inductive coupling to the associated first or second resonator internal conductor. It is also possible for a third coupling-in and/or coupling-out device to be arranged opposing the first or second coupling-in and/or coupling-out device, this preferably being arranged on the second face, which is opposite the first face. This can thus establish predominantly capacitive or predominantly inductive coupling to a first resonator internal conductor and/or a second resonator internal conductor in the first or second receiving chamber, the resonator internal conductor being arranged in the associated receiving chamber closest to the third coupling-in and/or coupling-out device. The third coupling-in and/or coupling-out device preferably passes through the opening. The coupling-in and/or coupling-out devices may also be arranged on the third or fourth face.

One end of the at least one first resonator internal conductor, which end is not galvanically connected to the filter frame or to the at least one separating web, comprises an extension portion in the direction of the first and/or second face of the filter frame, resulting in the at least one first resonator internal conductor being formed L-shaped or T-shaped in a plan view. This extension portion preferably extends exclusively parallel to the third or fourth face of the filter frame or parallel to the separating web. It could also extend at an inclination to the third or fourth face of the filter frame. The same also applies to the at least one second resonator internal conductor. This may also comprise an extension portion of this type. As a result, the electrically effective length of the associated resonator internal conductor is increased. At the same time, the capacitive coupling between the resonator internal conductor may also be extended towards the filter frame or the separating web via the extension portion.

The extension portions of all of the first resonator internal conductors or all of the second resonator internal conductors can thus all point in the same direction. They can also be orientated differently from one another.

So as to increase the inductive coupling between two adjacent resonator internal conductors, the adjacent resonator internal conductors can be galvanically connected via a coupling web. This coupling web may be arranged at a distance both from the filter frame and from the separating web. However, it should be arranged on the end of the resonator internal conductors at which the adjacent resonator internal conductor are galvanically connected to the filter frame and the separating web. The coupling web could also be galvanically connected to the filter frame or the separating web at the face thereof facing the filter frame or the separating web.

At least one capacitive and/or inductive coupling is provided between two resonator internal conductors which are non-adjacent or not consecutive on the signal transmission path.

Coupling of this type is preferably provided in the spacing region between the resonator internal conductors and the cover arrangement. An inductive coupling between the two resonator internal conductors is spaced apart from the other resonator internal conductors (positioned below) and from the cover arrangement. A capacitive coupling is spaced apart from all of the resonator internal conductors and from the cover arrangement. The capacitive coupling preferably has a larger area at the resonator internal conductors which are to be coupled than at the other resonator internal conductors.

The coaxial filter comprises a plurality of filter frames which are arranged above one another. The cover arrangement closes off the outer filter frame from the outside and comprises at least one intermediate cover. In each case, at least one intermediate cover is arranged between every two filter frames and separates them from one another. However, the intermediate cover comprises at least one coupling opening, through which coupling between at least two resonator internal conductors of different filter frames is provided. As a result, cascading can be provided or the individual filter paths can be extended.

BRIEF DESCRIPTION OF THE DRAWINGS

Various embodiments of the invention are described in the following by way of example with reference to the drawings. Like features in different drawing figures are designated by like reference numerals. In the corresponding drawings, in detail.

DETAILED DESCRIPTION OF NON-LIMITING EMBODIMENTS

Figure 1A:
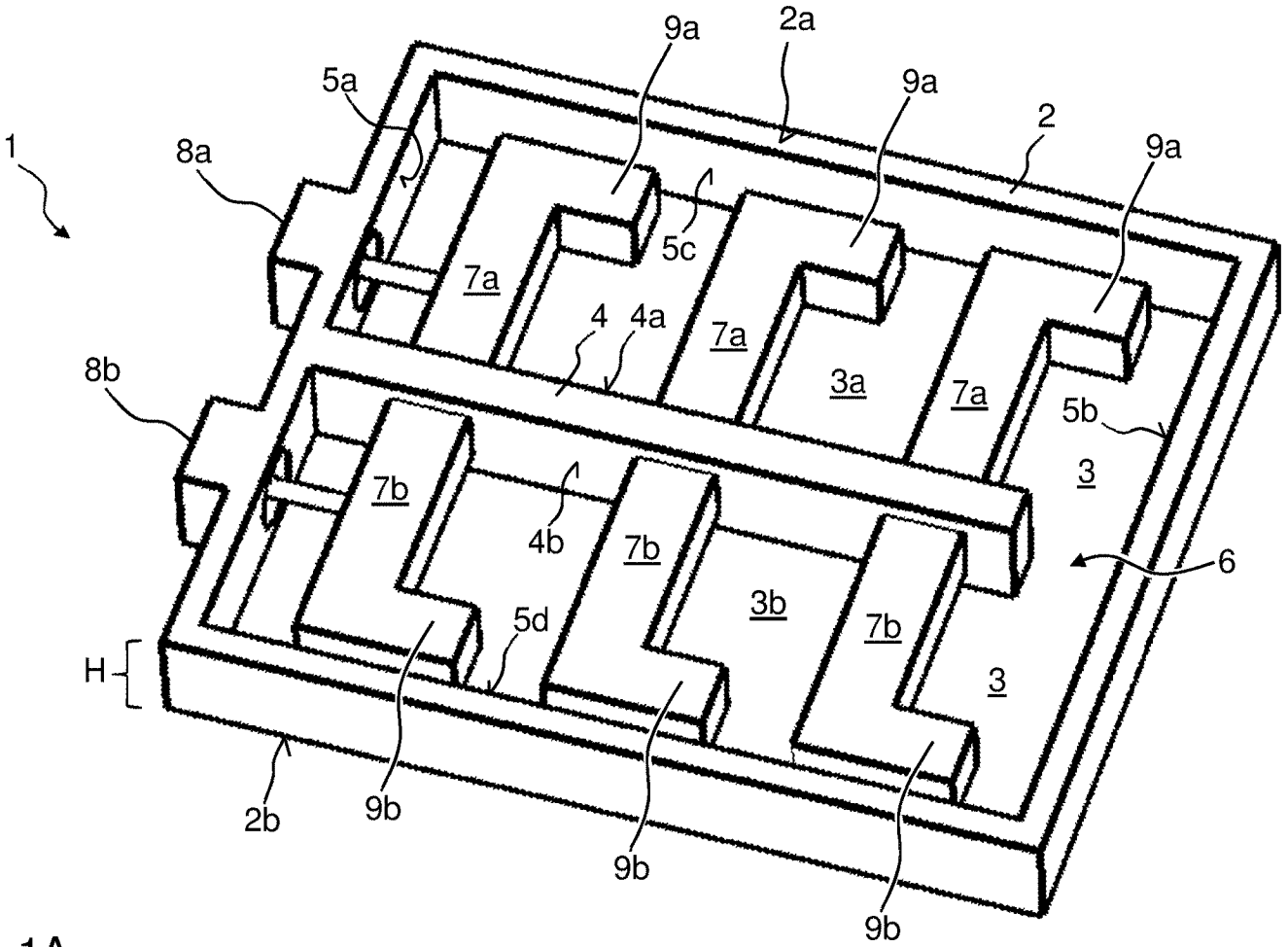
FIGS. 1A, 1A-1, 1B, 2A, 2B, 3A, 3B, 4A, 4B, 5A, 5B, 6, 7A, 7B, 7C, 8, 9, 10, 11, 12, 13, 14A, 14B, 15A and 15B show various embodiments of the coaxial filter having a frame construction and various longitudinal sections through the coaxial filter.
Figures 1, 1A:
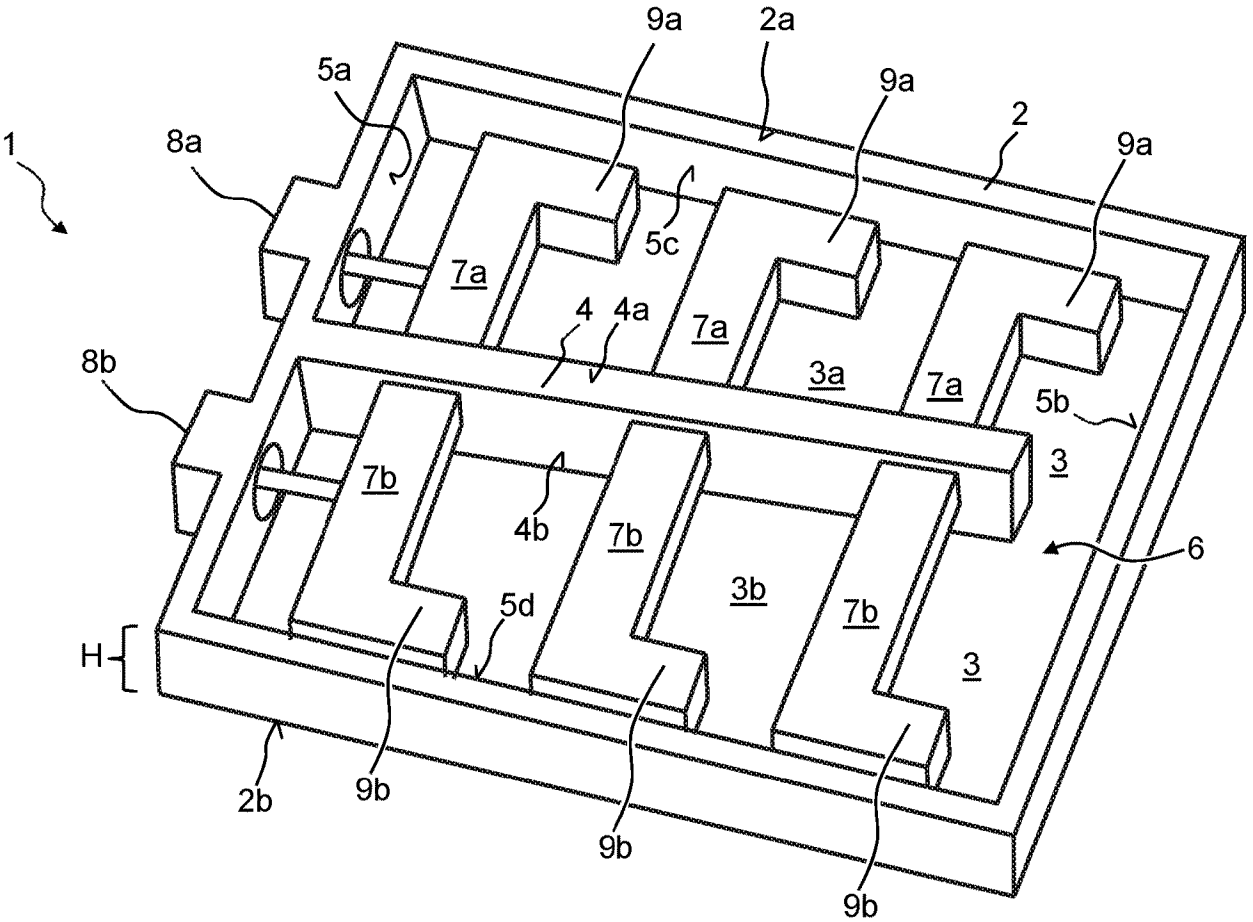
Figure 1B:
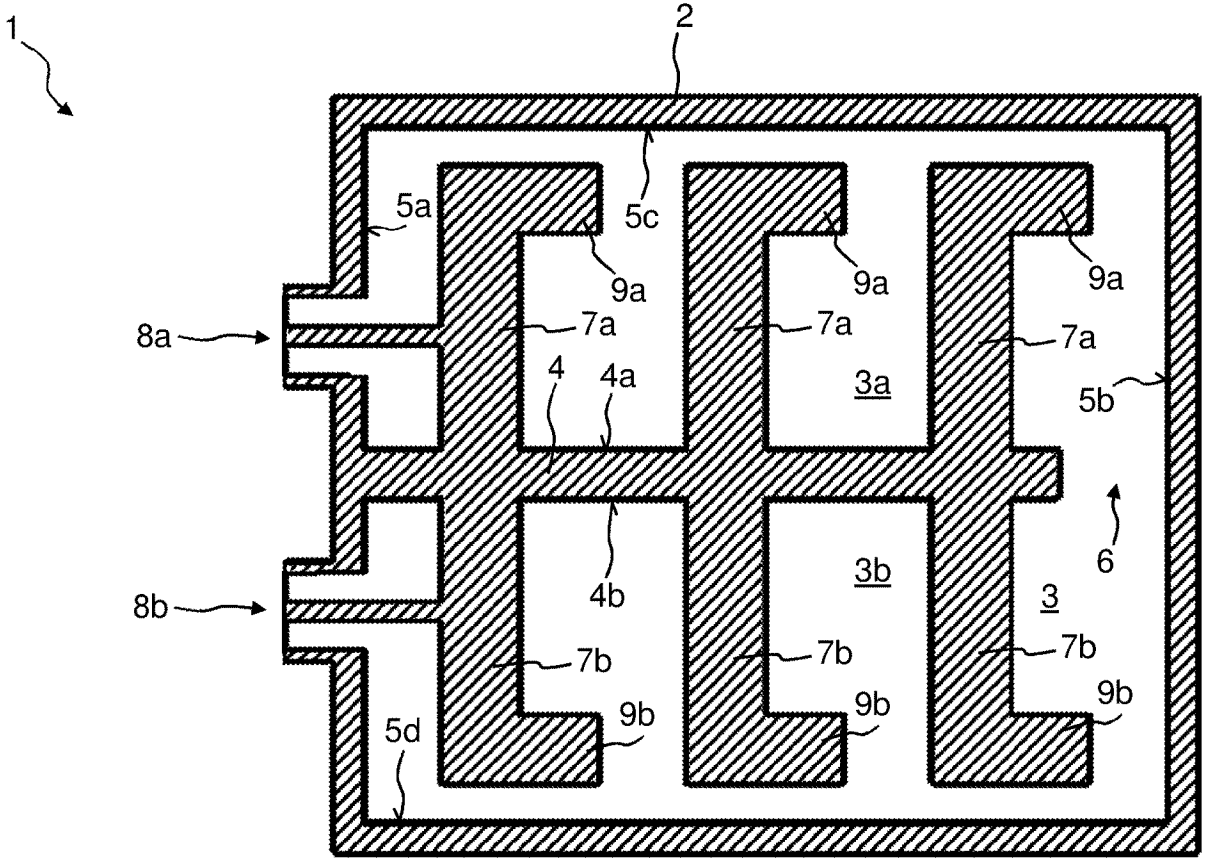

FIG. 1A is a three-dimensional representation of the coaxial filter 1 having a frame construction with the cover arrangement removed. FIG. 1B is a section, extending parallel to the removed cover arrangement, in the longitudinal direction through the coaxial filter 1 of FIG. 1A. The main component of the coaxial filter 1 is at least one filter frame 2, which consists of an electrically conductive material and comprises a receiving space 3, the receiving space 3 being arranged inside the at least one electrically conductive filter frame 2, resulting in the at least one electrically conductive filter frame 2 forming a border of the receiving space 3. The filter frame 2 is preferably rectangular or square or at least close to this shape in a plan view.

Figure 13:
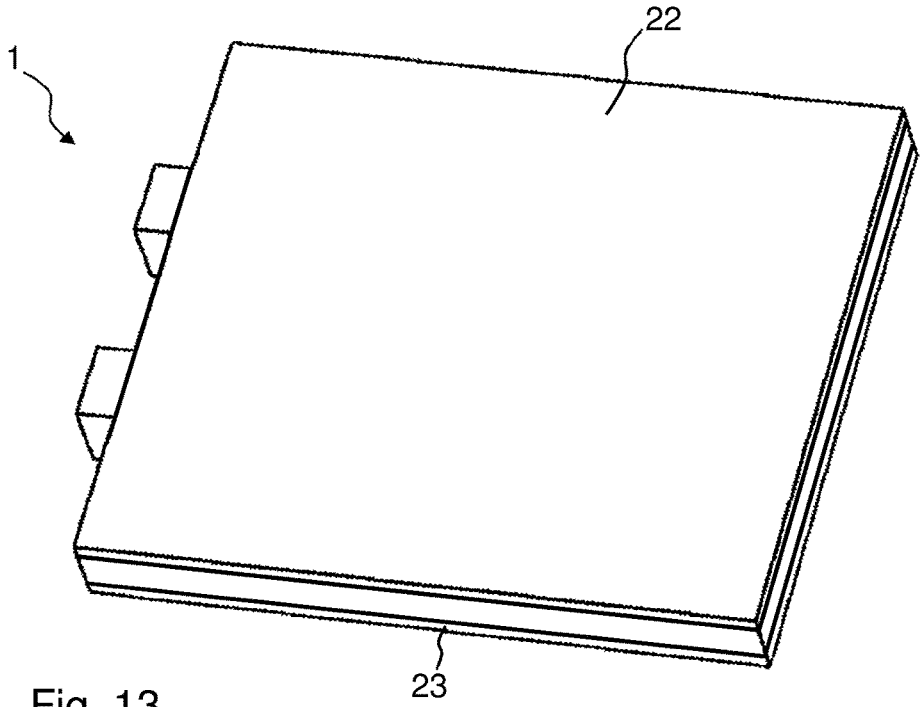
Figure 16:
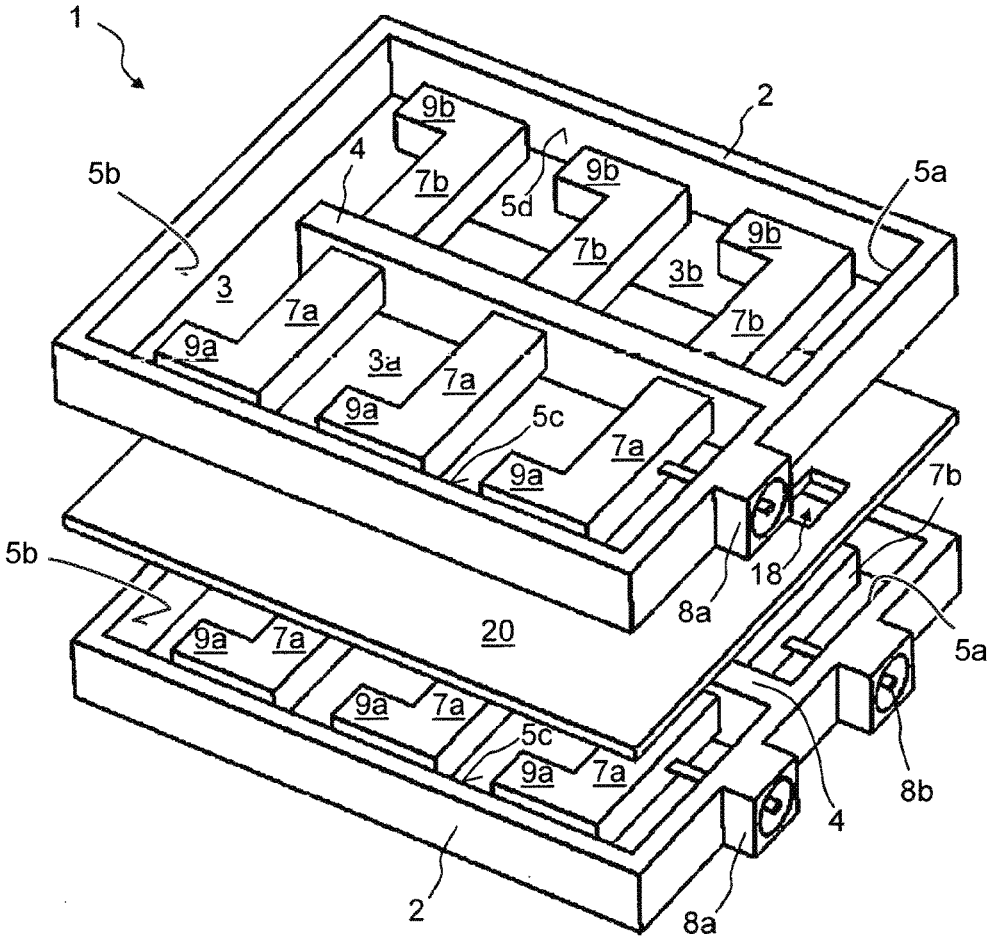
FIG. 16 shows an embodiment of the coaxial filter which exhibits a plurality of filter frames which are arranged above one another and are separated from one another by an intermediate cover of a cover arrangement.

The cover arrangement (not shown) closes the open ends, in other words the opposing wide faces of the at least one filter frame 2. In FIG. 1A, the cover arrangement would close the filter frame 2 from above and below. The cover arrangement may consist of one or more covers. Preferably, the cover arrangement comprises at least two outer covers 22, 23. A first outer cover 22 and second outer cover 23 of this type are shown in FIG. 13. The cover arrangement may further comprise at least one intermediate cover 20, such as can be seen in FIG. 16.

The first outer cover 22 is positioned on the upwards-facing or forwards-facing face 2*a* (FIG. 1A) of the filter frame 2. It is galvanically connected to the filter frame 2. The second outer cover 23 is positioned on the downwards-facing or rearwards-facing face 2*b* (FIG. 1A) of the filter frame 2 and is galvanically connected thereto. The two faces 2*a* and 2*b* extend mutually parallel.

FIGS. 1A and 1B show at least one electrically conductive separating web 4, which originates on a first face 5*a* of the at least one filter frame 2 and is galvanically conductively connected thereto. The at least one separating web 4 is formed integrally with the filter frame 2 and protrudes into the receiving space 3. The at least one separating web 4 extends in the direction of a second face 5*b*, opposing the first face 5*a*, where the web ends so as to form an opening 6. As a result, the receiving space 3 is divided into at least one first receiving chamber 3*a* and at least one second receiving chamber 3*b* and the opening 6 connecting the two receiving chambers 3*a*, 3*b*. At least one first resonator internal conductor 7*a* is arranged in the at least one first receiving chamber 3*a* of the receiving space 3. Within FIG. 1A, the at least one first resonator internal conductor 7*a* is galvanically connected to a first face 4*a* of the electrically conductive separating web 4, and extends therefrom in the direction of a third face 5*c* of the electrically conductive filter frame 2, and ends at a distance from the electrically conductive filter frame 2. It would also be possible for the at least one first resonator internal conductor 7*a* to comprise an electrically insulating coating, galvanically separating it from the electrically conductive filter frame 2. By way of the size of the distance between the at least one first resonator internal conductor 7*a* and the third face 5*c* of the filter frame 2, the capacitive coupling from the first resonator internal conductor 7*a* to the filter frame 2 can be adjusted. However, the distance is smaller, in particular many times smaller, than the length of the first resonator internal conductor 7*a* (extension from the separating web 4 in the direction of the filter frame 2).

The separating web 4 preferably has the same height H as the filter frame 2. This means that both the first outer cover 22 and the second outer cover 23 are positioned on the filter frame 2 and on the separating web 4 and are galvanically connected to both. They are preferably positioned over the entire first and second face 2*a*, 2*b* of the filter frame 2 or over the entire length of the separating web 4. The same also applies to the intermediate cover 20, which is shown in FIG. 16.

Figure 14A:
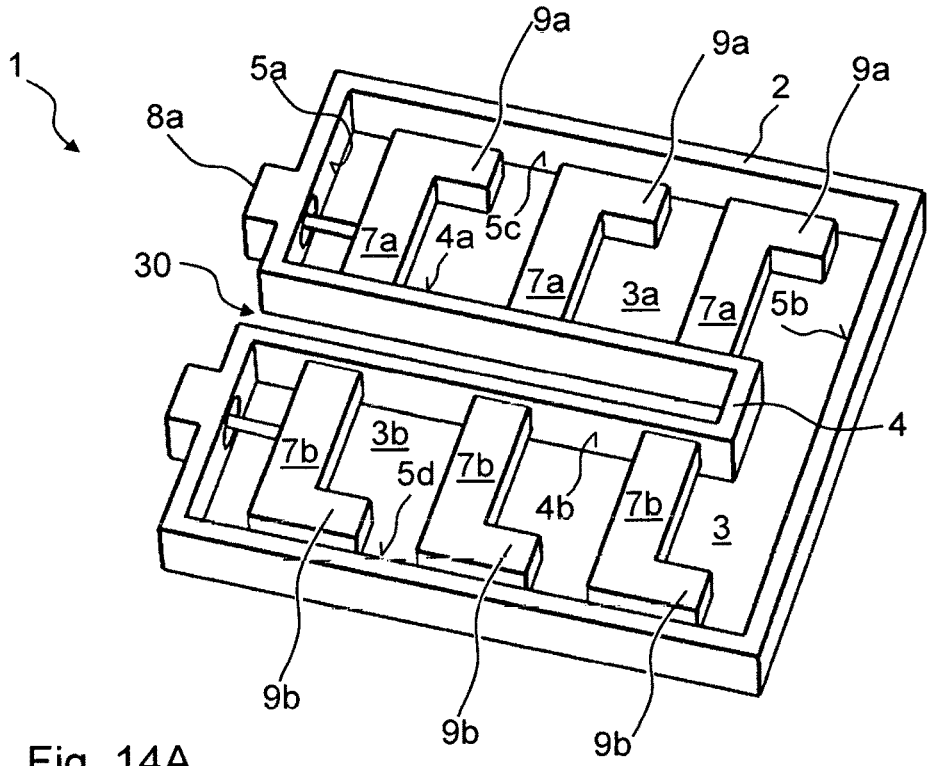
Figure 14B:
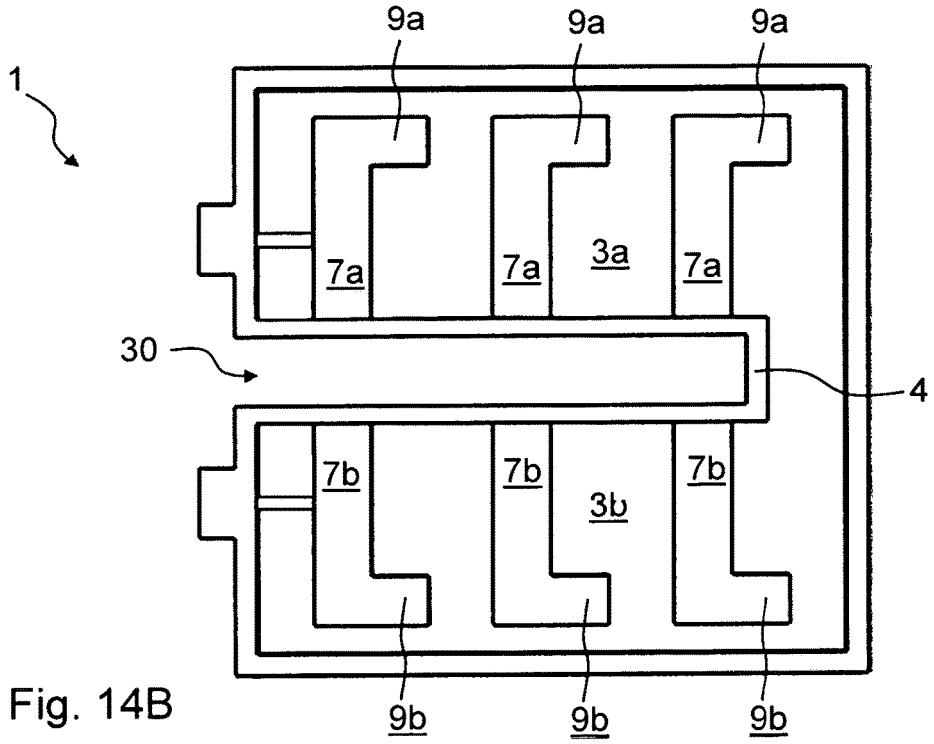

FIGS. 14A and 14B show that the separating web 4 is formed U-shaped in a plan view and comprises an outer space 30 which is separated from the receiving space 3 (FIG. 14A) or the first and second receiving chamber 3*a*, 3*b* and is accessible from outside the coaxial filter 1. This means that the separating web 4 comprises two longer, mutually separated side walls, which are interconnected by a shorter side wall. It would also be possible for the at least one separating web 4 to comprise a gap. In this case, a side peripheral wall of the filter frame 2 (FIG. 14A) would still be formed closed and rectangular. The separating web 4 would therefore be formed hollow at least in part. In one embodiment, the at least one separating web extends centrally; or eccentrically through the filter frame, resulting in two receiving chambers sized differently (if the separating web extends eccentrically).

Figure 15A:
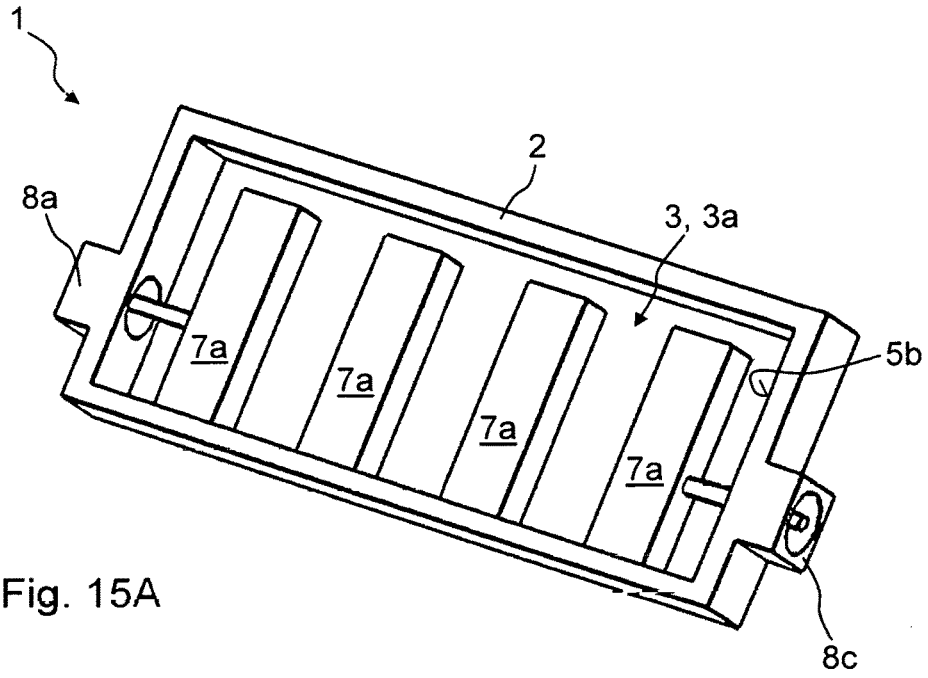
Figure 15B:
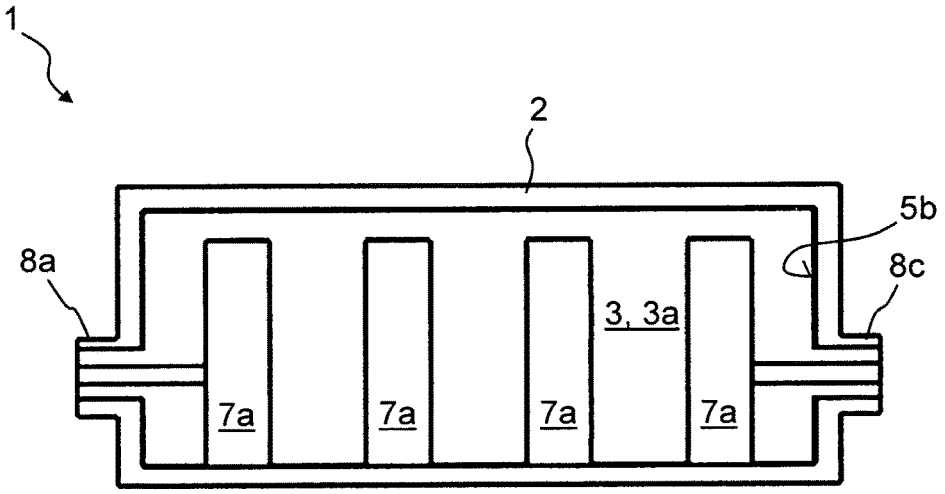

FIGS. 15A and 15B show an embodiment without the use of the separating web 4. Various first resonator internal conductors 7*a* are also formed. The at least one first resonator internal conductor 7*a* is galvanically connected to a face of the at least one electrically conductive filter frame 2, and extends therefrom in the direction of another, in particular opposing a face of the electrically conductive filter frame 2, and ends at a distance from the opposing face of the electrically conductive filter frame 2 and/or is galvanically separated from the opposing face of the electrically conductive filter frame 2. The coaxial filter 1 comprises a third coupling-in and/or coupling-out device 8*c*, which is arranged on the second face 5*b* of the at least one filter frame 2 and has predominantly capacitive or predominantly inductive coupling. In FIG. 15A, predominantly inductive coupling to the first resonator internal conductor 7*a* arranged closest to the second face 5*b* in the first receiving chamber 3*a* is provided.

In FIG. 1A, there are three first resonator internal conductors 7*a*. However, fewer or many more first resonator internal conductors 7*a* may also be formed.

The coaxial filter 1 of FIGS. 1A and 1B further comprises a second resonator internal conductor 7*b*. In FIG. 1A, the second resonator internal conductor 7*b* is galvanically connected to the second face 4*b* of the electrically conductive separating web 4, and extends therefrom in the direction of a fourth face 5*d* of the electrically conductive filter frame 2, and likewise ends at a distance from the electrically conductive filter frame 2 and/or is galvanically separated therefrom. The same statements made previously for the first resonator internal conductor 7*a* apply here.

The resonator internal conductors 7*a*, 7*b* preferably have a height that is smaller than the height H of the filter frame 2. This means that the outer covers 22, 23 and if applicable the intermediate cover 20 of the cover arrangement are spaced apart from the resonator internal conductors 7*a*, 7*b* and not positioned thereon.

The first face 5*a* of the filter frame 2 extends parallel to the second face 5*b* of the filter frame 2. The third face 5*c* of the filter frame 2 extends parallel to the fourth face 5*d* of the filter frame 2. The third and fourth face 5*c*, 5*d* of the filter frame 2 extend perpendicular to the first and second face 5*a*, 5*b* of the filter frame 2.

In FIG. 1B, it can be seen that the at least one separating web 4 and the resonator internal conductors 7*a*, 7*b* are formed integrally. The same also applies to the at least one separating web 4 and the filter frame 2.

Figure 3A:
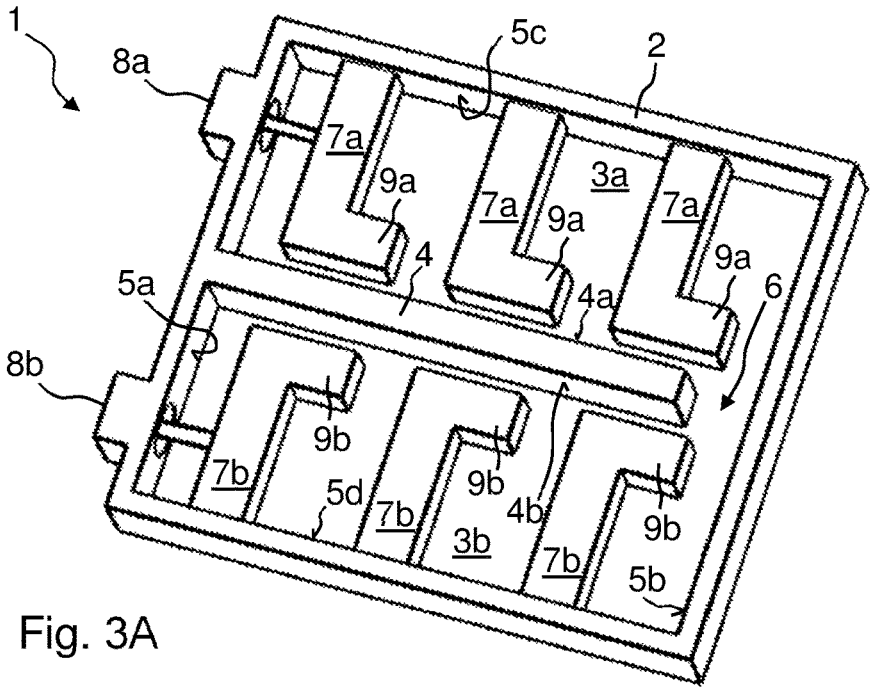
Figure 3B:
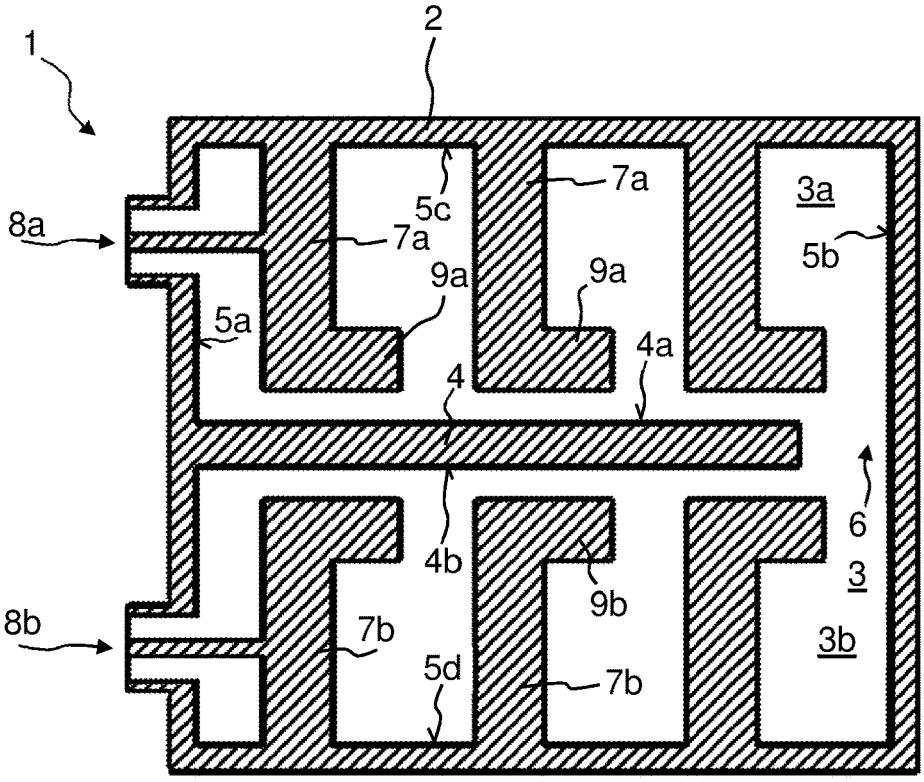

In this regard, reference is made to FIGS. 3A and 3B. FIG. 3A is likewise a three-dimensional representation of another embodiment of a coaxial filter 1, while FIG. 3B is a section through the embodiment of FIG. 3A along the longitudinal axis. In FIG. 3A, the at least one first resonator internal conductor 7*a* is galvanically connected to the third face 5*c* of the at least one electrically conductive filter frame 2, and extends therefrom in the direction of the first face 4*a* of the electrically conductive separating web 4, and ends at a distance from the electrically conductive separating web 4 and/or is galvanically separated from the electrically conductive separating web 4. The same also applies to the second resonator internal conductor 7*b*. This is galvanically connected to the fourth face 5*d* of the at least one electrically conductive filter frame 2, and extends therefrom in the direction of the second face 4*b* (FIG. 3B) of the electrically conductive separating web 4, and ends at a distance from the separating web 4 and/or is galvanically separated from the separating web 4.

Figure 2A:
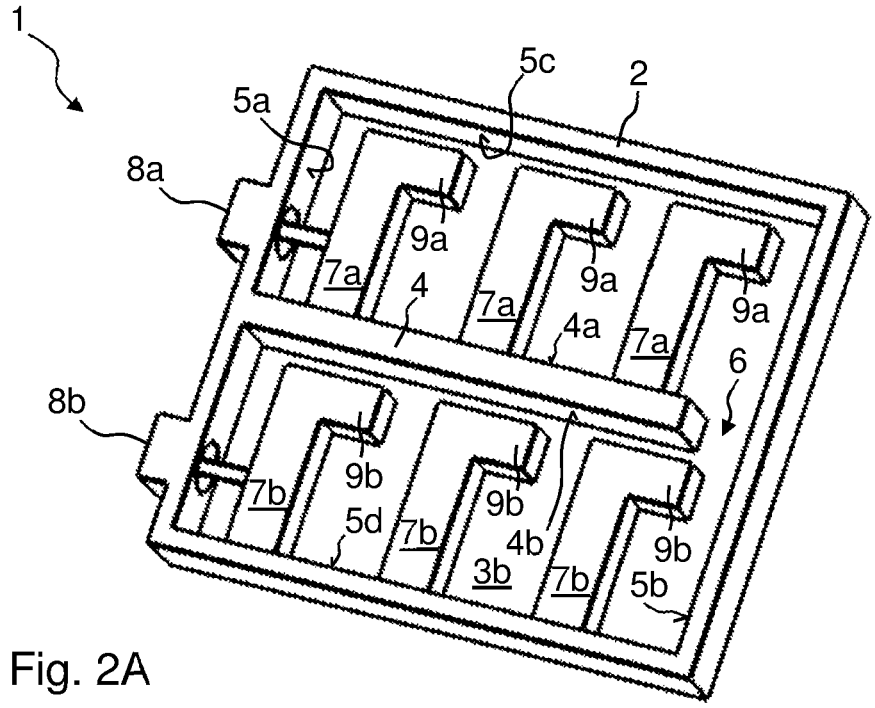
Figure 2B:
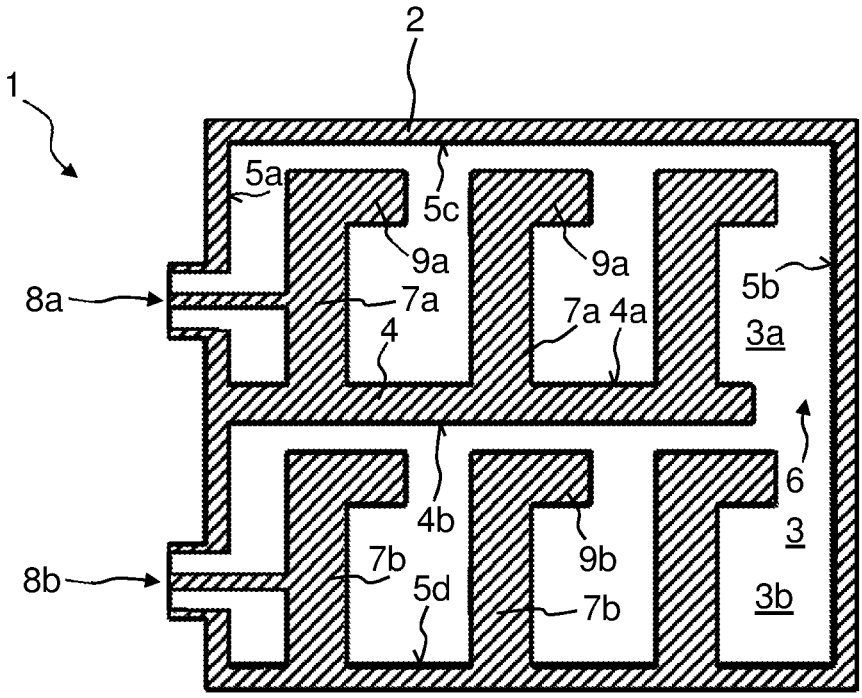

Preferably as shown in FIG. 2B, the at least one first resonator internal conductor 7*a* is arranged in the at least one first receiving chamber 3*a* of the receiving space 3, while the at least one second resonator internal conductor 7*b* is arranged in the at least one second receiving chamber 3*b* of the receiving space 3.

Further, the resonator internal conductor 7*a*, 7*b*, the at least one separating web 4 and the corresponding filter frame 2 are formed integrally. Production is preferably by casting, in particular pressure casting, such as aluminium pressure casting. However, it would also be possible for the coaxial filter 1 to be produced by a milling process.

The coaxial filter 1 of FIG. 2A comprises a first resonator internal conductor 7*a*, which is galvanically connected to the first face 4*a* of the electrically conductive separating web 4, and extends therefrom in the direction of the third face 5*c* of the filter frame 2, and ends at a distance from the filter frame 2. By contrast, the second resonator internal conductor 7*b* is galvanically connected to the fourth face 5*d* of the filter frame 2, and extends therefrom in the direction of the second face 4*b* of the electrically conductive separating web 4, and ends at a distance from the electrically conductive separating web 4. It would also be possible for the at least one first resonator internal conductor 7*a* to be connected to the third face 5*c* of the filter frame 2, while the second resonator internal conductor 7*b* is connected to the second face 4*b* of the separating web 4. FIG. 2B is a corresponding longitudinal section through the coaxial filter 1 of FIG. 2A, specifically in a section plane parallel to the removed cover arrangement.

It would also be conceivable for some of the first and second resonator internal conductors 7*a*, 7*b* to be connected alternately to the corresponding face of the filter frame 2 or of the separating web 4.

The coaxial filter 1 further comprises a first coupling-in and/or coupling-out device 8*a*, which is arranged on the first face 5*a* of the at least one filter frame 2 and establishes predominantly capacitive or predominantly inductive coupling to the first resonator internal conductor 7*a* arranged closest to the first face 5*a* in the first receiving chamber 3*a*. FIG. 1A involves inductive coupling.

The coaxial filter 1 further comprises at least one second coupling-in and/or coupling-out device 8*b*, which is arranged on the first face 5*a* of the at least one filter frame 2 and establishes predominantly capacitive or predominantly inductive coupling to the second resonator internal conductor 7*b* arranged closest to the first face 5*a* in the second receiving chamber 3*b*. Each coupling-in and/or coupling-out device 8*a*, 8*b* is preferably directly coupled exclusively to only one resonator internal conductor 7*a*, 7*b*.

Figure 17:
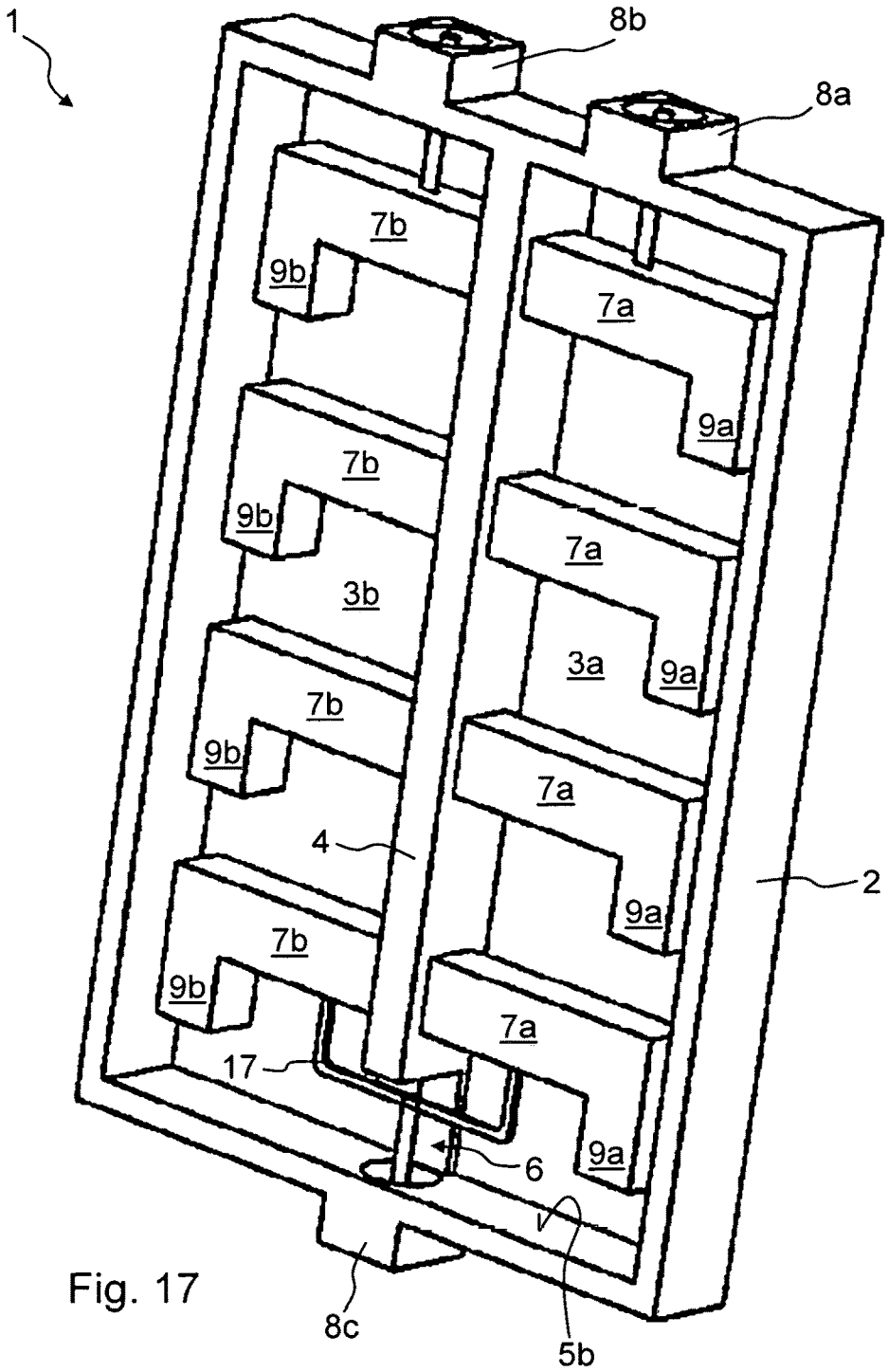
FIGS. 17, 18A and 18B show further embodiments of the coaxial filter having a frame construction.

In FIG. 17, which shows a further embodiment of the coaxial filter 1, a third coupling-in and/or coupling-out device 8*c* can be seen, which is arranged on the second face 5*b* of the at least one filter frame 2 and comprises predominantly capacitive or predominantly inductive coupling. In FIG. 17, predominantly inductive coupling to the first resonator internal conductor 7*a* arranged closest to the second face 5*b* in the first receiving chamber 3*a* is provided. At the same time, predominantly inductive coupling to the resonator internal conductor 7*b* arranged closest to the second face 5*b* in the second receiving chamber 3*b* is also provided. It would also be possible for the third coupling-in and/or coupling-out device 8*c* to establish capacitive or inductive coupling to only one resonator internal conductor 7*a*, 7*b*. The third coupling-in and/or coupling-out device 8*c* extends through the opening 6.

In FIG. 1A, the at least one separating web 4 extends centrally through the filter frame 2. However, it could also extend eccentrically through the filter frame 2, resulting in the two receiving chambers 3*a*, 3*b* being of different sizes in this case. See FIG. 1A-1.

The at least one separating web 4 extends eccentrically in particular if the coaxial filter also has m further separating webs 4, where m≥1, which subdivide the receiving chamber 3 into m further receiving chambers 3*a*, 3*b*, the m further receiving chambers 3*a*, 3*b* comprising at least one further resonator internal conductor 7*a*, 7*b* each. In this case, the m further separating webs 4 may be galvanically conductively connected alternately to the first and second face 5*a*, 5*b* of the at least one filter frame 2, resulting in the individual receiving chambers 3*a*, 3*b* being interconnected in a meander shape. As a result, the length of the filter path can be increased. The further separating webs 4 may also all be galvanically conductively connected to the at least one filter frame 2 on the first face 5*a* thereof, and protrude into the receiving space 3, and extend in the direction of the second face 5*b*, where they end so as to form an opening 6 thereon. In this case, there are a plurality of filter paths, preferably each filter path comprising its own coupling-in and/or coupling-out device 8*a*, 8*b* which is arranged on the first face 5*a* of the filter frame 2.

Just like the at least one second resonator internal conductor 7*b*, the at least one first resonator internal conductor 7*a* is individually connected to the filter frame 2 or the separating web 4 at one point. This one point is referred to as a foot point. The at least one first resonator internal conductor 7*a* is therefore not connected to the cover arrangement, just like the at least one second resonator internal conductor 7*b*. This means that the at least one first resonator internal conductor 7*a* and the at least one second resonator internal conductor 7*b* have a smaller height than the filter frame 2, resulting in them being spaced apart from the cover arrangement by a predetermined amount. This distance is preferably less than the actual thickness of the resonator internal conductor 7*a*, 7*b*. This preferably applies to all of the resonator internal conductors 7*a*, 7*b*.

Figure 12:
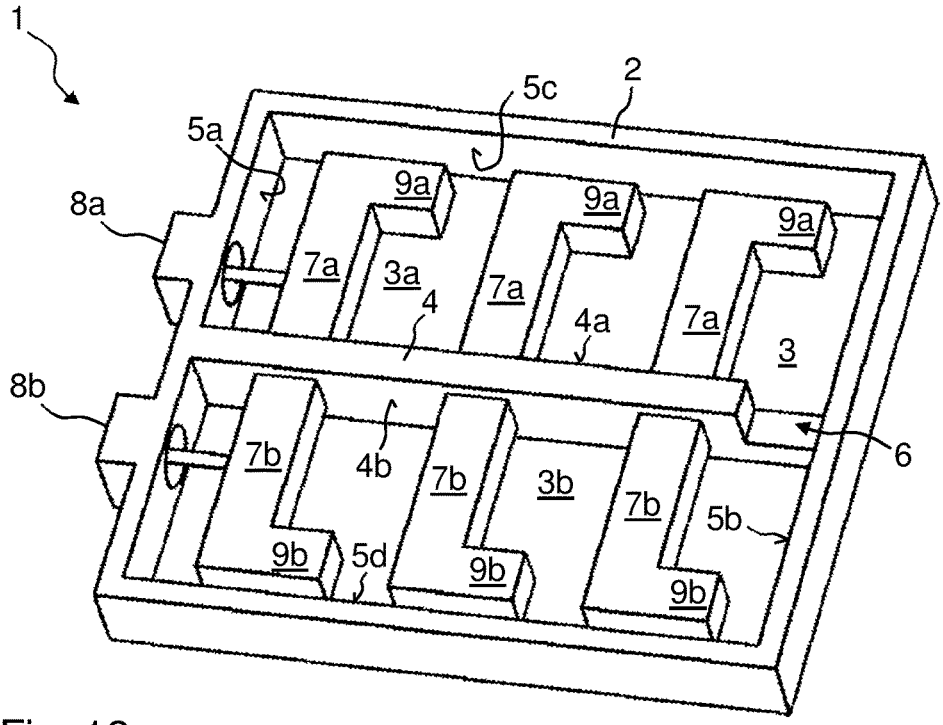

In FIG. 1A, the separating web 4 is completely spaced apart from the second face 5*b* of the filter frame 2. As a result, the opening 6 is formed. In FIG. 12, the at least one separating web 4 is galvanically connected to the second face 5*b* of the filter frame 2 at least in part, the separating web 4 having a smaller height than the filter frame 2 towards a cover arrangement (not shown) at the transition to the second face 5*b* of the filter frame 2, resulting in the opening 6 being formed. The separating web 4 comprises a dent or recess here which causes the opening 6 to be formed.

So as to increase the electrically effective length of the resonator internal conductors 7*a*, 7*b*, in FIG. 1A, a second end of the at least one first resonator internal conductor 7*a*, opposing the first end (this end forms the foot point), is supplemented or extended in the direction of the second face 5*b* of the filter frame 2 by an extension portion 9*b*. As a result, the first resonator internal conductor 7*a* has the shape of an L in a plan view. The same also applies to the second resonator internal conductor 7*b*. This also has an extension portion 9*b*, which extends in the direction of the second face 5*b* of the filter frame 2. It would also be possible for the extension portion 9*a*, 9*b* of the first or second resonator internal conductor 7*a*, 7*b* to extend in the direction of the first face 5*a* of the filter frame 2. The extension portion 9*a*, 9*b* could also extend both in the direction of the first face 5*a* and in the direction of the second face 5*b* of the filter frame 2. In this case, the associated resonator internal conductor 7*a*, 7*b* would be T-shaped in a plan view. As a result, a larger surface is implemented towards the filter frame 2 or in FIGS. 3A and 3B towards the separating web 4, strengthening the capacitive coupling.

In FIG. 1A, the two extension portions 9*a*, 9*b* of the two resonator internal conductors 7*a*, 7*b* extend in the same direction, and in this case in the direction of the second face 5*b* of the filter frame 2. They could also both point in the direction of the first face 5*a* of the filter frame 2.

The extension portions 9*a*, 9*b* preferably extend perpendicularly away from the associated resonator internal conductors 7*a*, 7*b*.

The extension portions 9*a*, 9*b* are preferably as wide as the associated resonator internal conductor 7*a*, 7*b*. The extension portions 9*a*, 9*b* may also be narrower or wider.

The extension portions 9*a*, 9*b* are preferably shorter than the associated resonator internal conductor 7*a*, 7*b*. The extension portions 9*a*, 9*b* are preferably shorter than the associated resonator internal conductor 7*a*, 7*b* by more than half. However, the extension portions 9*a*, 9*b* could also be longer, i.e. the ones which face themselves through the opening 6.

The ends of the extension portions 9*a*, 9*b* of the resonator internal conductors 7*a*, 7*b* closest to the second face 5*b* of the filter frame can protrude beyond the end of the at least one separating web 4. The two extension portions 9*a*, 9*b* of the two resonator internal conductors 7*a*, 7*b* therefore protrude beyond the opening 6 in direct visual contact with one another, causing coupling to be achieved. However, a direct visual contact is not needed. If there is not direct visual contact the coupling is weaker.

At least one, preferably all, of the extension portions 9*a*, 9*b* extend exclusively parallel to the third or fourth face 5*c*, 5*d* of the filter frame 2. They could also extend at an inclination to the third or fourth face 5*c*, 5*d* of the filter frame 2. The two ends of a resonator internal conductor 7*a*, 7*b* are preferably equally thick and preferably spaced equally far apart from the covers enclosing them of the cover arrangement.

The distances between the individual resonator internal conductors 7*a* of a receiving chamber 3*a* are preferably equally large. The same also applies to the distances between the second resonator internal conductors 7*b* in the second receiving chamber 3*b*. The distances between the individual resonator internal conductors 7*a*, 7*b* may also be varied.

Figure 4A:
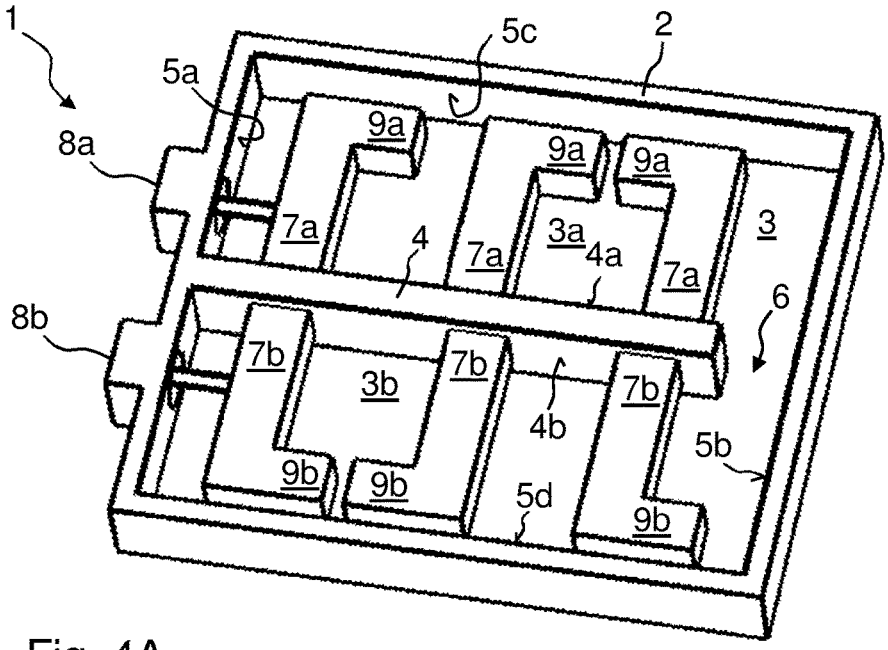
Figure 4B:
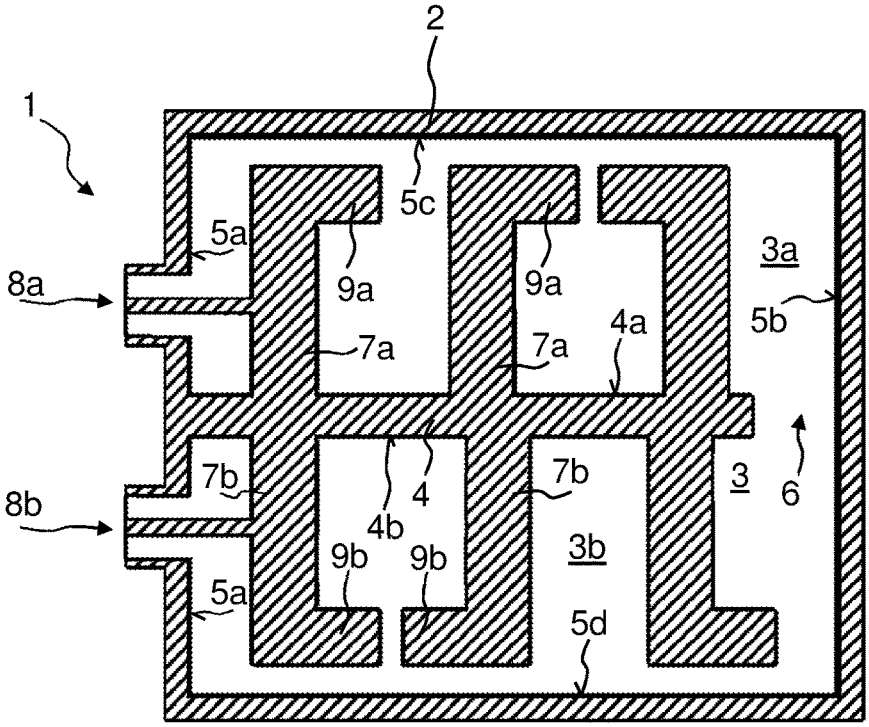

In FIG. 4A and in the associated longitudinal section in FIG. 4B, the extension portions 9*a* of the first resonator internal conductors 7*a* do not all point in the same direction, for example in a direction towards the second face 5*b* of the filter frame 2. In FIG. 4A, two extension portions 9*a* of two adjacent first resonator internal conductors 7*a* point towards one another. The distance between the two extension portions 9*a* is preferably less than the distance from the associated resonator internal conductor to the filter frame 2. However, it could also be equally large or larger.

Figure 5A:
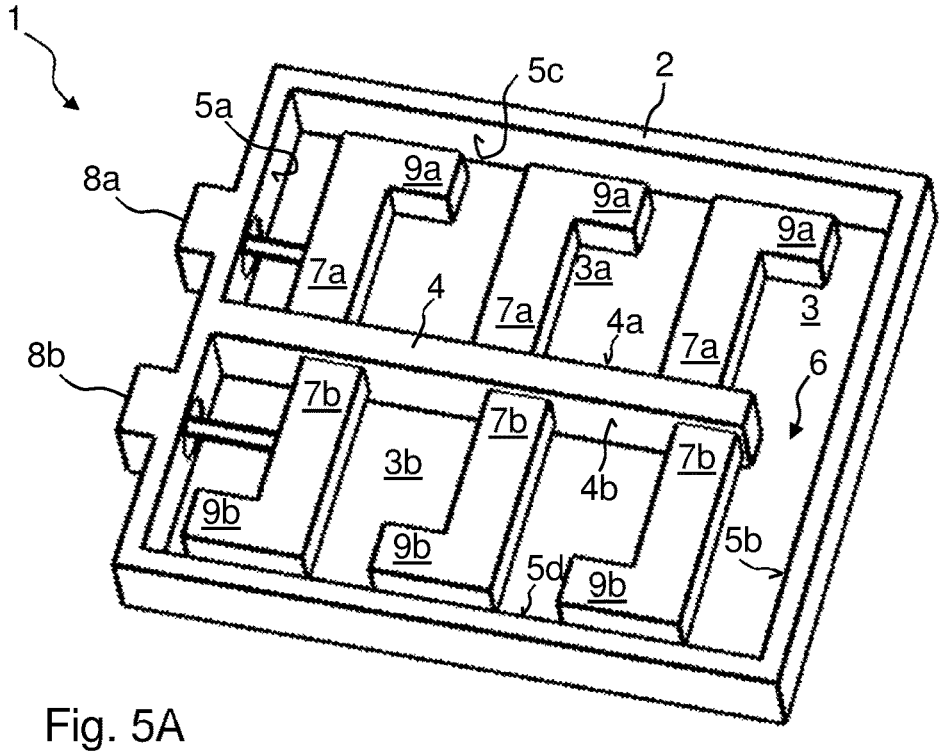
Figure 5B:
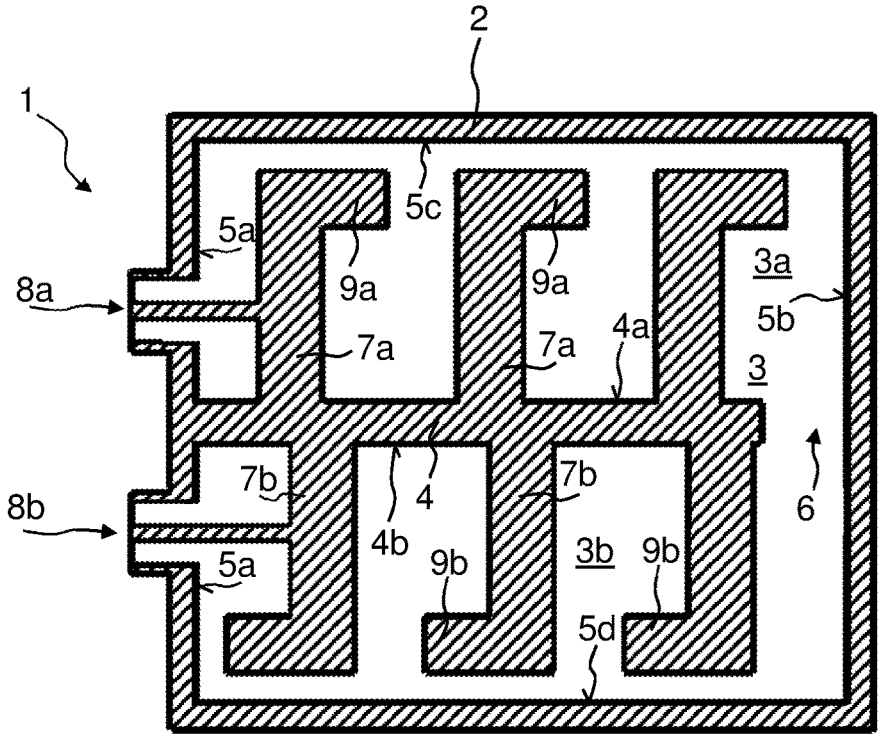

The same also applies to the extension portions 9*b* of the second resonator internal conductor 7*b*. In FIGS. 5A and 5B, all of the extension portions 9*a* of the first resonator internal conductor 7*a* point in the same direction, in this case in the direction of the second face 5*b* of the filter frame 2, while all of the extension portions 9*b* of the second resonator internal conductors 7*b* point in the opposite direction, in other words in this case in the direction of the first face 5*a* of the filter frame 2.

Figure 10:
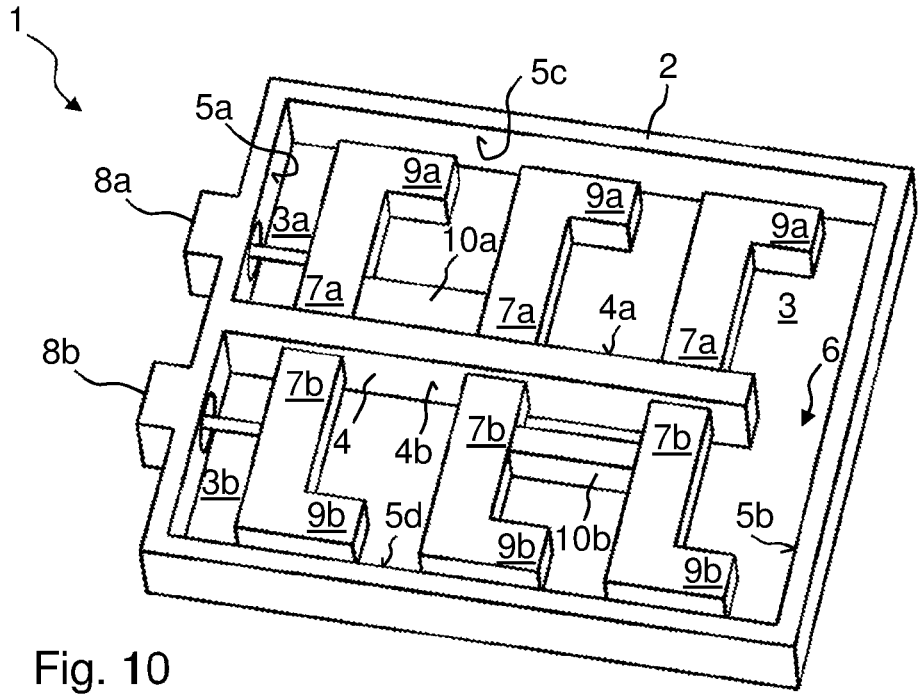

FIG. 10 shows a strengthened inductive coupling between two adjacent first resonator internal conductors 7*a*. For this purpose, a first coupling web 10*a* is used, which galvanically interconnects the two adjacent resonator internal conductors 7*a*. The face of the first coupling web 10*a* facing the at least one separating web 4 is galvanically connected to the at least one separating web 4 (being integrally formed). The inductive coupling is strongest if the connection is provided at the foot point of the associated resonator internal conductor 7*a*. Further, FIG. 10 shows an inductive coupling between two adjacent second resonator internal conductors 7*b*. The second coupling web 10*b* used is arranged at a distance from the filter frame 2 and at a distance from the at least one separating web 4. The inductive coupling via the second coupling web 10*b* is less than the inductive coupling via the first coupling web 10*a*, since it is further away from the foot point of the associated resonator internal conductor 7*b*. The second coupling web 10*b* is also formed integrally with the second resonator internal conductors 7*b*.

The first and second coupling webs 10*a*, 10*b* are attached to the side faces of the adjacent first and second resonator internal conductors 7*a*, 7*b*, which are arranged parallel to the first and second face 5*a*, 5*b* of the filter frame 2. The coupling webs 10*a*, 10*b* are preferably attached in the first half of the length of the resonator internal conductors 7*a*, 7*b*. The first half starts from the foot point of the resonator internal conductor 7*a*, 7*b*.

Figure 11:
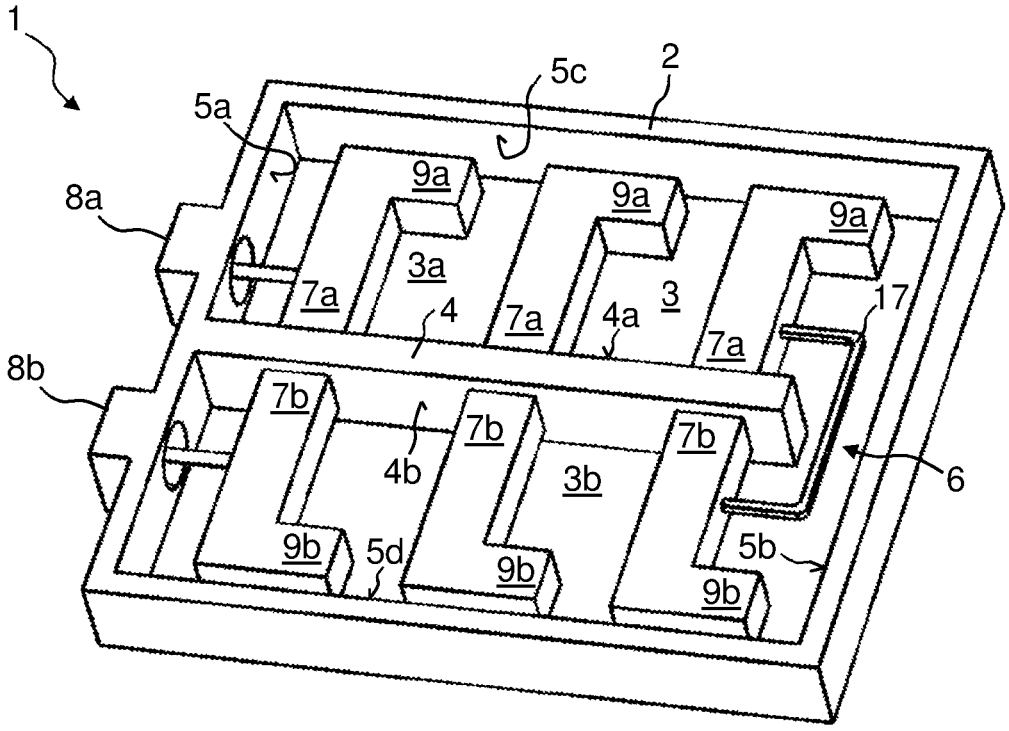

FIG. 11 shows an inductive coupling between the two resonator internal conductors 7*a*, 7*b* arranged closest to the second face 5*b* of the filter frame 2. The inductive coupling is provided via the opening 6 using a coupling rod 17. This coupling rod 17 can be soldered to the two resonator internal conductors 7*a*, 7*b*. An integral formation of the coupling rod 17 with the two resonator internal conductors 7*a*, 7*b* is also conceivable.

Figure 9:
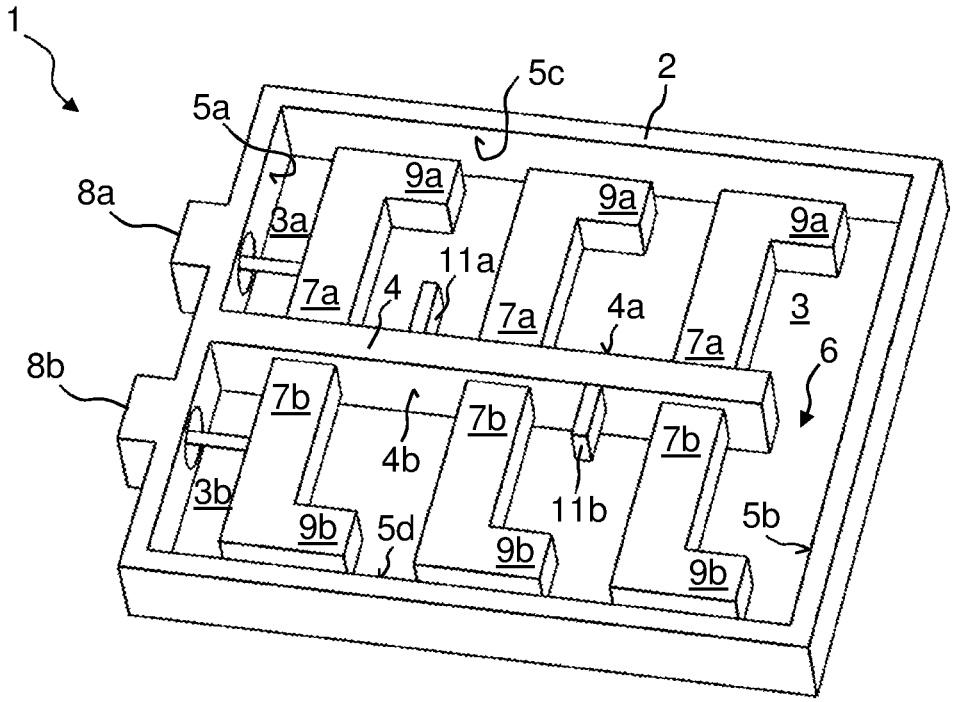

To adjust the coupling between two adjacent resonator internal conductors 7*a*, 7*b*, separating screens or separating walls 11*a*, 11*b* are used. FIG. 9 shows that at least one first separating screen 11*a* (also referred to as a first separating wall) is arranged between two adjacent first resonator internal conductors 7*a* so as to reduce the coupling of the two first resonator internal conductors 7*a*. The at least one first separating screen 11*a* is connected galvanically, in this case, to the first face 4*a* of the at least one separating web 4, and protrudes into the first receiving chamber 3*a* by a particular length. It would likewise be possible for the first separating screen 11*a* to be galvanically connected to the third face 5*c* of the filter frame 2 and to protrude therefrom into the first receiving chamber 3*a*. The first separating screen 11*a* could also be arranged on the cover arrangement (not shown).

Likewise, a second separating screen 11*b* (also referred to as a second separating wall) is formed, which is arranged between two adjacent second resonator internal conductors 7*b*. The same statements apply thereto as to the first separating screen 11*a*.

The separating screens 11*a*, 11 *b* are preferably the same height as the separating web 4 and the filter frame 2. When a cover arrangement is placed on, they preferably contact the cover arrangement. They are therefore preferably galvanically connected, on the opposing faces thereof, to the associated cover arrangement which is placed on (for example outer covers 22, 23 in FIG. 13 or intermediate cover 20 in FIG. 16).

The separating screens 11*a*, 11*b* may also consist of two parts, the two parts converging towards the centre from two opposing faces 5*c*, 4*a* and ending so as to form a gap with respect to one another. The two parts are therefore preferably positioned diametrically opposite one another. The separating screens 11*a*, 11*b* and the separating web 4 or filter frame 2 are preferably formed integrally.

Figure 8:
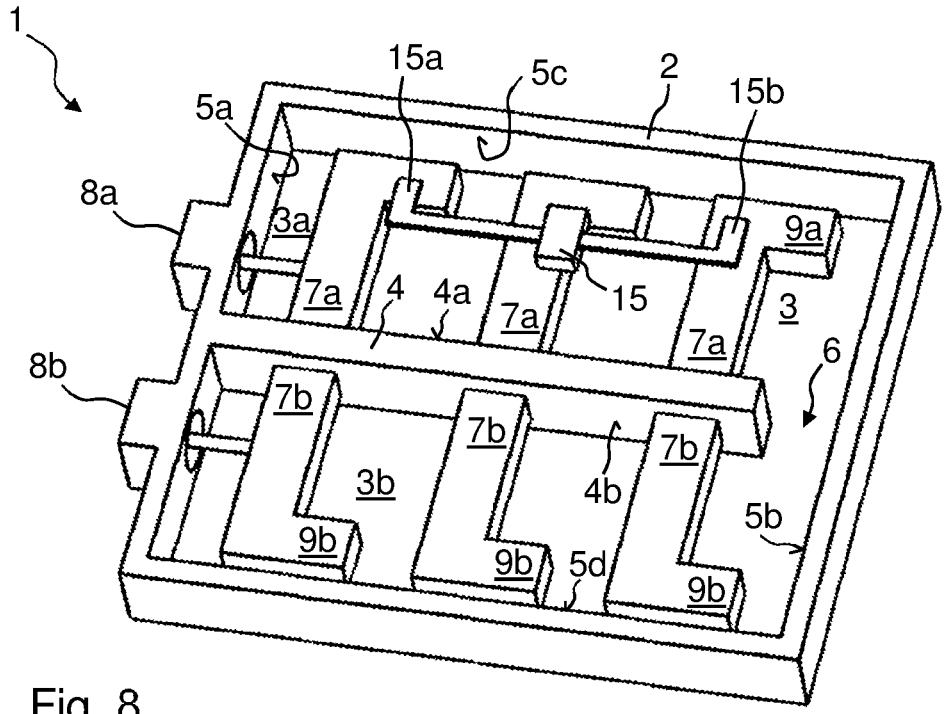

In FIG. 8, at least one capacitive coupling 15 is shown between two resonator internal conductors 7*a* in the same receiving chamber 3*a*. The capacitive coupling is formed by a coupling element 15, which has at least two mechanically and galvanically interconnected capacitive coupling faces 15*a*, 15*b*, each of these capacitive coupling faces 15*a*, 15*b* being arranged spaced apart between one of the two resonator internal conductors 7*a* and the cover arrangement. The coupling element 15 is galvanically separated from the resonator internal conductors 7*a*, the at least one separating web 4 and the filter frame 2. The coupling element 15 is therefore preferably held by a dielectric and is thus spaced apart from the aforementioned elements. Via the dielectric, the coupling element 15 is positioned galvanically separated on a first resonator internal conductor 7*a*.

In FIG. 8, the coupling element 15 extends exclusively in the first receiving chamber 3*a*. It would also be possible for it to extend exclusively in the second receiving chamber 3*b*. The capacitive coupling faces 15*a*, 15*b* of the coupling element 15 are preferably placed on via the extension portion 9*a* of the resonator internal conductor 7*a*. They should be positioned over the associated first resonator internal conductor 7*a* as far away as possible from the foot point thereof. The capacitive coupling faces 15*a*, 15*b* are therefore preferably arranged more on the end of the first resonator internal conductor 7*a* which is not galvanically connected to the separating web 4 or the filter frame 2, and thus is spaced furthest apart therefrom. The same would also apply to a coupling element 15 positioned in the second receiving chamber 3*b*.

Figure 7A:
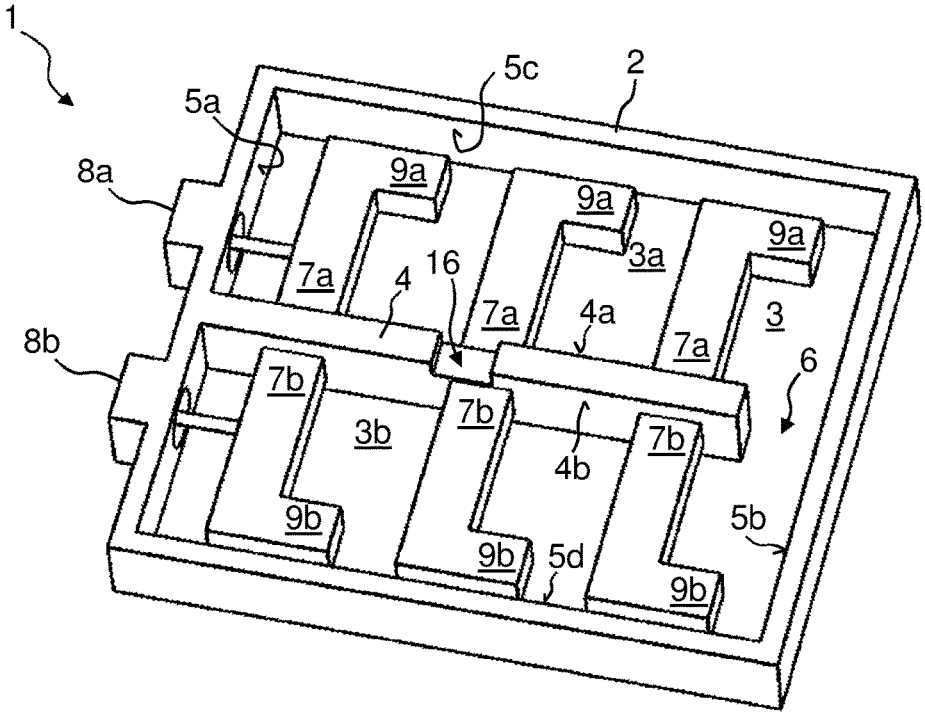
Figure 7B:
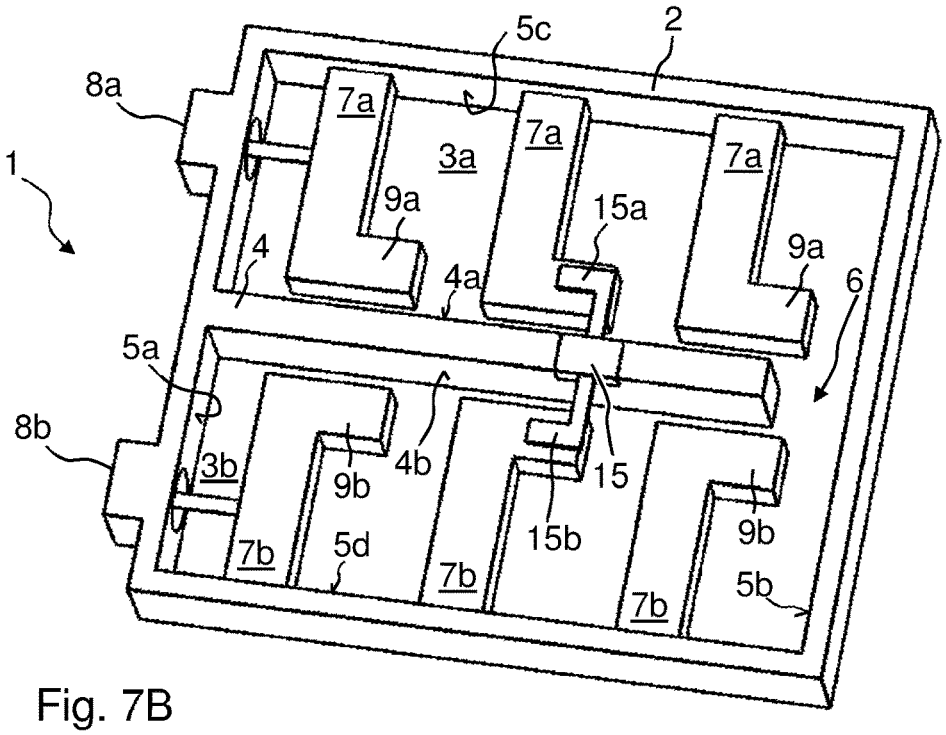
Figure 7C:
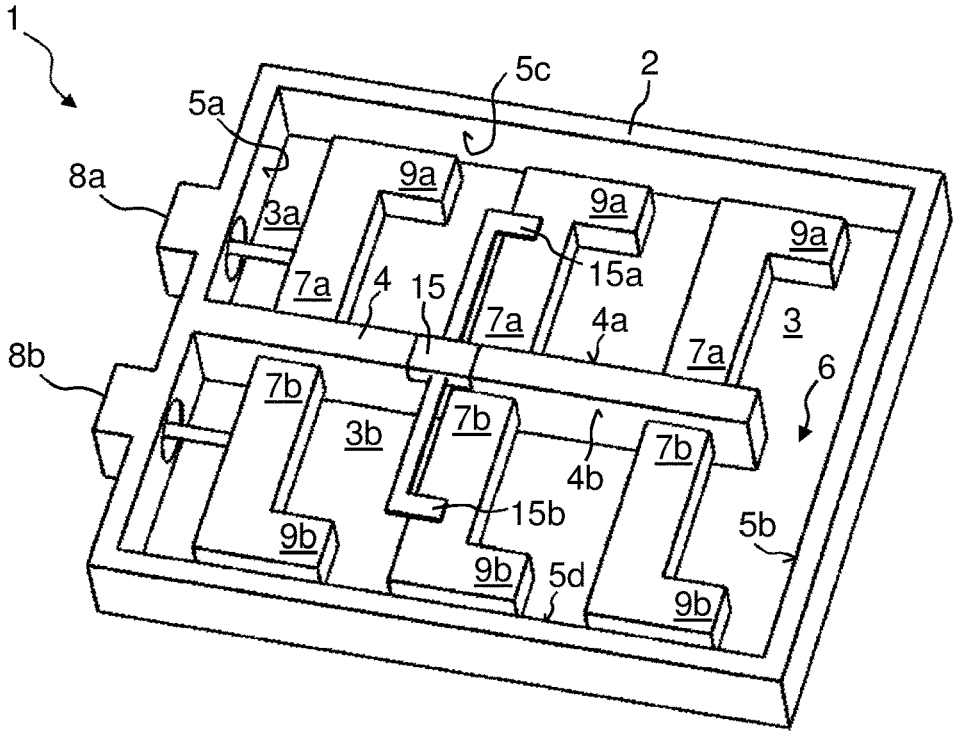

In FIG. 7C, the coupling element 15 extends from the first receiving chamber 3*a* via a further recess 16, formed in the at least one separating web 4, in the second receiving chamber 3*b*. This recess 16 can be seen in FIG. 7A.

The coupling element 15 is preferably arranged in equal parts in the first and in the second receiving chamber 3*a*, 3*b*. The coupling faces 15*a*, 15*b* each face in the same direction, and preferably in the direction in which the extension portions 9*a*, 9*b* are also directed. In FIG. 7C, the coupling element 15 is galvanically separated from the separating web 4. The recess 16 is completely sealed by the dielectric, which encloses the coupling element 15 over the entire periphery over a particular length. In this case, the coupling element 15 is a web, which has the coupling faces 15*a*, 15*b*, preferably extending perpendicular to the web extension, at both ends. These are preferably wider than the web. The web itself is preferably completely enclosed by the dielectric along a particular length. The dielectric results in galvanic separation towards the cover arrangement or separating web 4 or the first or second resonator internal conductor 7*a*, 7*b*.

In FIG. 7B, the web has a shorter length than in FIG. 7C. The web should be of a length such that the coupling faces 15*a*, 15*b* come to be positioned over the extension portions 9*a*, 9*b* of the resonator internal conductor 7*a*, 7*b*.

Figure 6:
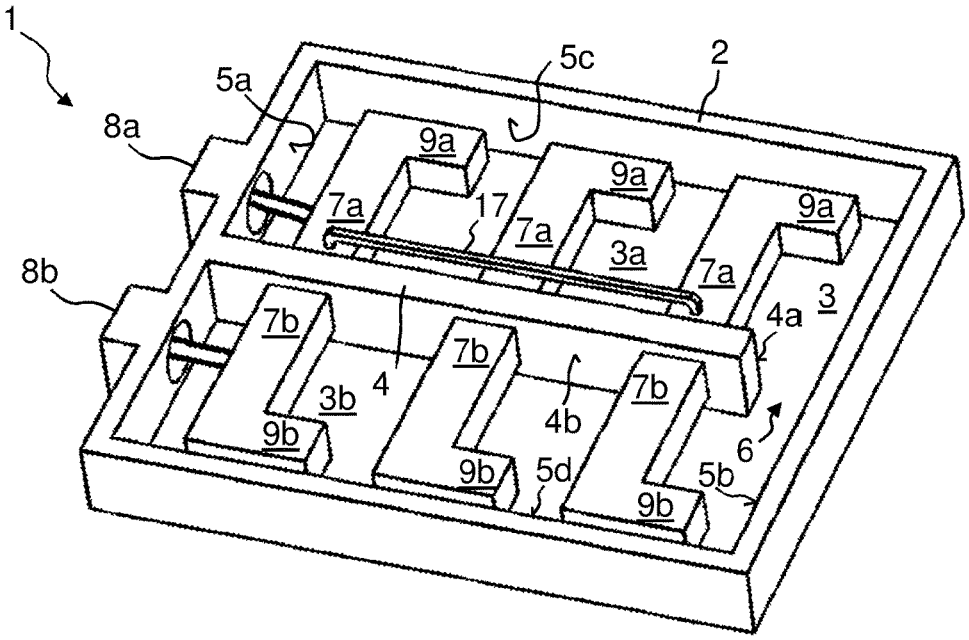

FIG. 6 again shows an inductive coupling between two resonator internal conductors 7*a* in the same receiving chamber 3*a*. FIG. 11 shows an inductive coupling of this type between two resonator internal conductors 7*a*, 7*b* in two different receiving chambers 3*a*, 3*b*. In FIG. 6, the inductive coupling is provided between two resonator internal conductors 7*a* which are non-adjacent or not consecutive on the signal transmission path. The inductive coupling between two resonator internal conductors 7*a* is formed by the coupling rod 17, which is galvanically connected to the two resonator internal conductors 7*a* and extends between them and the cover arrangement. The coupling rod 17 comprises two ends, which are preferably elbowed, and is galvanically connected at these ends, in particular by a soldering process, to the two resonator internal conductors 7*a*. The coupling rod 17 is preferably galvanically connected to the resonator internal conductor 7*a* closer to the foot point thereof than to the free ends thereof. The inductive coupling could also be contactless. In FIG. 6, the coupling rod 17 extends exclusively in the first receiving chamber 3*a*. However, it could also extend exclusively in the second receiving chamber 3*b*. In FIG. 11, the coupling rod 17 extends from the first receiving chamber 3*a* via the opening 6 into the second receiving chamber 3*b*. It would also be possible for the coupling rod 17 to extend via a further recess, such as is shown for example in FIG. 7A for the capacitive coupling element 15, through the at least one separating web 4.

FIG. 16 shows that the coaxial filter 1 comprises a total of n filter frames 2, where n≥2, at least one separating web 4 comprising first and second resonator internal conductors 7*a*, 7*b* being formed in each filter frame 2. The n filter frames 2 are arranged above one another and preferably completely overlap. These filter frames 2 are therefore arranged coincidently above one another. Preferably, all of the filter frames 2 have the same dimensions. This applies in particular to the width (from face 5*c* to face 5*d*) and length (from face 5*a* to face 5*d*). Preferably, they may individually differ in height from one another.

The cover arrangement (not shown) closes off the outer filter frame 2 at one face. The cover arrangement further comprises at least n−1 intermediate covers 20. At least one of the intermediate covers 20 is arranged between every two filter frames 2. The at least one intermediate cover 20 comprises at least one coupling opening 18, through which coupling between at least two resonator internal conductors 7*a*, 7*b* of different filter frames 2 is provided.

Thus, the filter path can be extended in a very simple manner, while the coaxial filter 1 is simultaneously of a compact construction. Different filter paths can thus also be combined with one another.

Figure 18A:
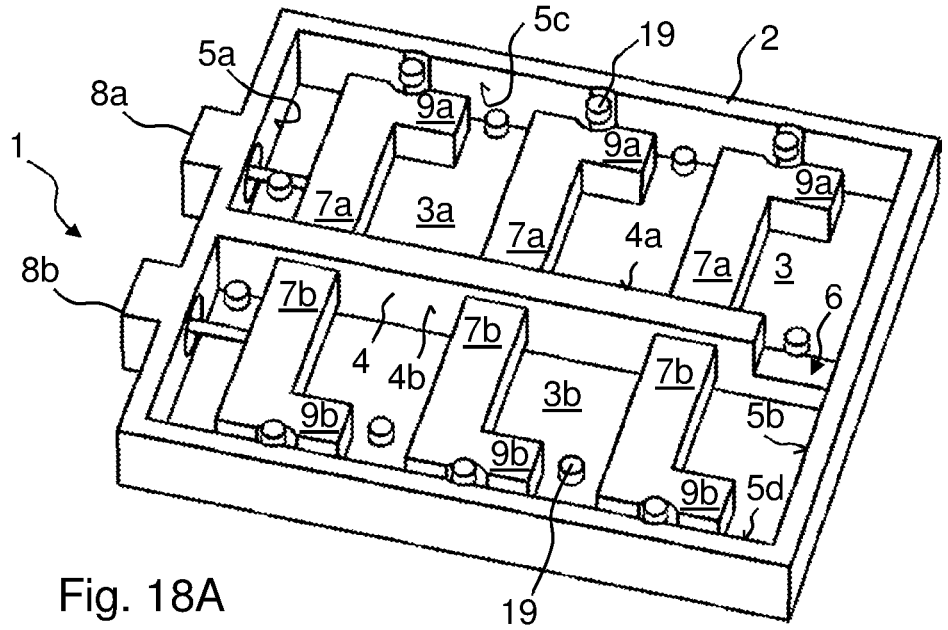
Figure 18B:
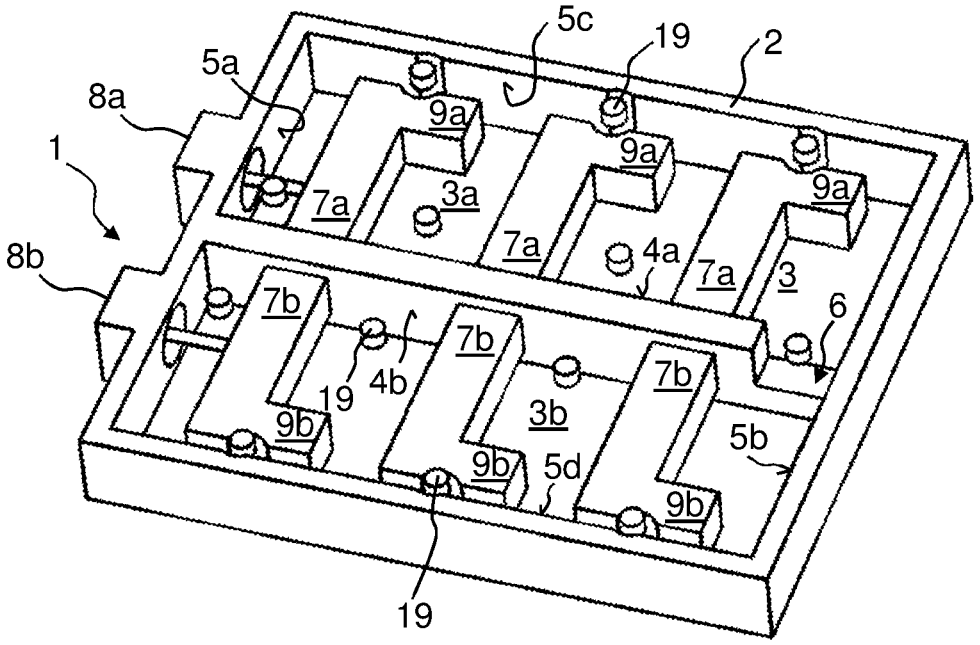

FIGS. 18A and 18B show that different tuning elements 19 can be screwed into the individual receiving chambers 3*a*, 3*b* through the cover arrangement.

For this purpose, the resonator internal conductors 7*a*, 7*b* comprise, on the end at which they are galvanically separated from the filter frame 2 or separating web 4 (FIG. 18A), a recess which is preferably circle sector-shaped in a plan view and into which the tuning element 19 extends. This recess which is circle-sector-shaped in a plan view may also continue in the filter frame 2, as shown in FIGS. 18A and 18B, or in the separating web 4.

The tuning elements 19 may also be arranged alongside the extension portion 9*a* or 9*b* of the associated resonator internal conductor 7*a*, 7*b*.

For the coaxial filter 1 having a frame construction, the following facts also apply.

A surface of the at least one first and/or second resonator internal conductor 7*a*, 7*b*, which extends parallel to the cover arrangement, in other words to the outer covers 22, 23, is larger than the largest side face of the at least one first and/or second resonator internal conductor 7*a*, 7*b*, which extends transverse, preferably perpendicular, to the cover arrangement, in other words to the outer covers 22, 23 in FIG. 13. In FIG. 1A, the first resonator internal conductor 7*a* comprises for example five side faces and two surfaces. One surface is arranged adjacent to the first outer cover 22 and a further surface is arranged adjacent to the second outer cover 23.

A cross section and a longitudinal section through the at least one first and/or second resonator internal conductor 7*a*, 7*b* is preferably polygonal, in particular rectangular or square.

A surface of the at least one first and/or second separating screen 11*a*, 11*b* in FIG. 9 which extends parallel to the cover arrangement, in other words to the outer covers 22, 23, is smaller than the largest or smallest side face of the at least one first and/or second separating screen 11*a*, 11*b* which extends transverse, preferably perpendicular, to the cover arrangement, in other words to the outer covers 22, 23, in FIG. 9, the at least one first separating screen 11*a* comprises three side faces and two surfaces. One surface is arranged adjacent to the first outer cover 22 and a further surface is adjacent to the second outer cover 23. Preferably, one or both surfaces of the at least one first separating screen 11*a* are galvanically connected to one or both outer covers 22, 23 (they are in contact). The same preferably likewise applies to the at least one second separating screen 11*b*. By contrast, the surfaces of the resonator internal conductors 7*a*, 7*b* are arranged out of contact with the outer covers 22, 23, in other words spaced apart therefrom.

Figure 19:
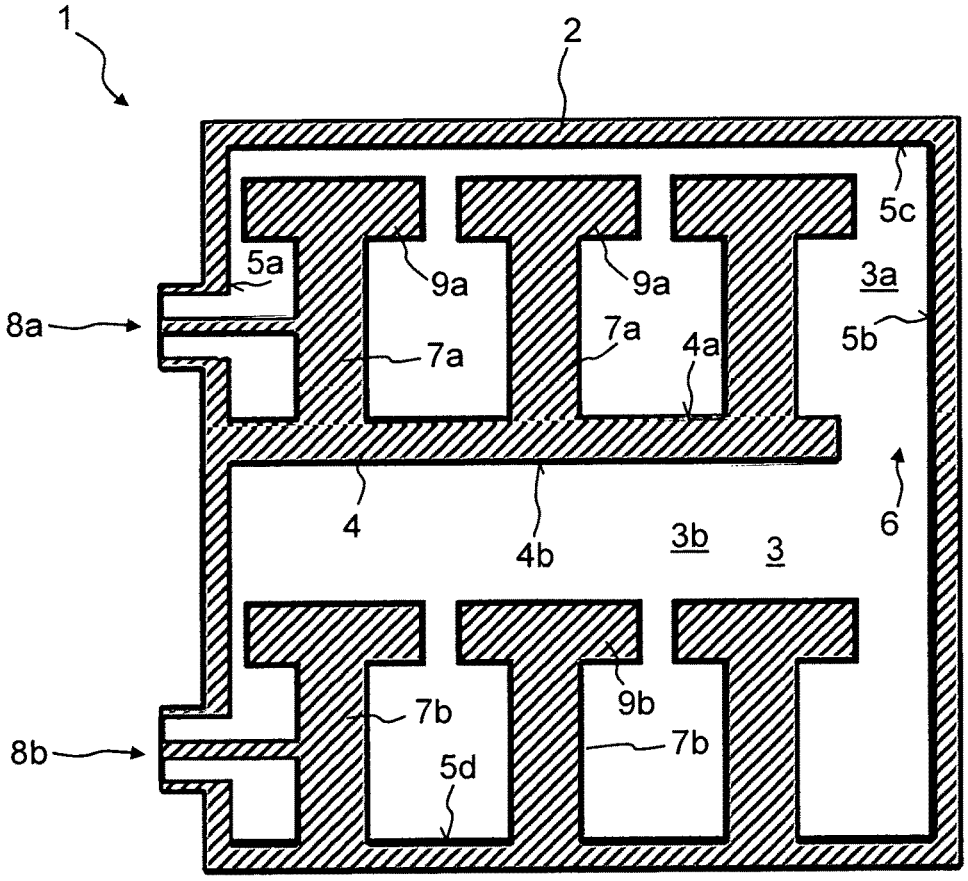
FIG. 19 shows a cross-sectional view of a coaxial filter.

Two directly adjacent first and/or second resonator internal conductors 7*a*, 7*b* which are arranged in the same receiving chamber 3*a*, 3*b* preferably have visual contact with one another. See e.g., FIG. 19. Preferably, a receiving chamber 3*a*, 3*b* comprises at least two resonator internal conductors 7*a*, 7*b*. Separating devices within the associated receiving chamber 3*a*, 3*b*, such as separating screens 11*a*, 11*b* (FIG. 9), do not extend over the entire width of the associated receiving chamber 3*a*, 3*b*. The width is defined for example by the at least one separating web 4 with respect to the third face 5*c* or the fourth face 5*d* of the filter frame 2. As a result, (direct) coupling of two resonator internal conductors 7*a*, 7*b* in the same receiving chamber 3*a*, 3*b* is possible, even if this coupling is weaker when a separating screen 11*a*, 11*b* is used than without one.

The invention is not limited to the embodiments described. Within the scope of the invention, all described and/or illustrated features can be combined with one another as desired.

The invention claimed is:

1. A coaxial filter comprising:

a filter frame comprising an electrically conductive medium, the filter frame forming a border of a receiving space, the filter frame having first, second, third and fourth faces;

an electrically conductive separating web originating on the first face of the filter frame and galvanically conductively connected thereto, the electrically conductive separating web protruding into the receiving space, and extending in the direction of the second face, opposing the first face, of the filter frame where the web ends so as to form an opening therewith, causing the receiving space to be divided at least into a first receiving chamber and a second receiving chamber wherein the opening connects the first and second receiving chambers;

a cover disposed on two open ends of the filter frame, in such a way that the receiving space is closed on all sides;

a first resonator internal conductor disposed in the first receiving chamber of the receiving space;

a second resonator internal conductor being arranged in the second receiving chamber of the receiving space;

the filter frame being formed integrally together with the electrically conductive separating web and the first and second resonator internal conductors;

the first resonator internal conductor being galvanically connected to:

a1) the third face of the filter frame, and extending therefrom in the direction of the electrically conductive separating web, and ending at a distance from the electrically conductive separating web or being galvanically separated from the electrically conductive separating web; or b1) the separating web, and extending therefrom in the direction of the third face of the filter frame, and ending at a distance from the filter frame or being galvanically separated from the filter frame; and the second resonator internal conductor being galvanically connected to:

a2) the fourth face of the filter frame, and extending therefrom in the direction of the electrically conductive separating web, and ending at a distance from the electrically conductive separating web or being galvanically separated from the electrically conductive separating web; or b2) the electrically conductive separating web, and extending therefrom in the direction of the fourth face of the filter frame, and ending at a distance from the filter frame or being galvanically separated from the filter frame.

2. Coaxial filter having a frame construction, comprising:

at least one filter frame, which consists of an electrically conductive medium and has a receiving space having a first receiving chamber, the receiving space being arranged inside the at least one filter frame, resulting in the at least one filter frame forming a border of the receiving space;

a cover arrangement, which is arranged on two open ends of the at least one filter frame, in such a way that the receiving space is closed on all sides;

at least one first resonator internal conductor is arranged in the receiving space;

at least one electrically conductive separating web originating on a first face of the at least one filter frame and being galvanically conductively connected thereto, and protruding into the receiving space, and extending in the direction of a second face, opposing the first face, of the at least one filter frame where the web ends so as to form an opening therewith, causing the receiving space to be divided at least into the first receiving chamber and a second receiving chamber and the opening connecting the first and second receiving chambers;

the at least one first resonator internal conductor being arranged in the first receiving chamber of the receiving space;

the at least one first resonator internal conductor being:

a) galvanically connected to a third face of the at least one filter frame, and extending therefrom in the direction of a first face of the at least one electrically conductive separating web, and ending at a distance from the electrically conductive separating web or being galvanically separated from the electrically conductive separating web; or b) galvanically connected to the first face of the at least one electrically conductive separating web, and extending therefrom in the direction of the third face of the at least one filter frame, and ending at a distance from the at least one filter frame or being galvanically separated from the at least one filter frame; and at least one second resonator internal conductor being arranged in the second receiving chamber of the receiving space;

the at least one second resonator internal conductor being:

a) galvanically connected to a fourth face of the at least one filter frame, and extending therefrom in the direction of a second face of the at least one electrically conductive separating web, and ending at a distance from the at least one electrically conductive separating web or being galvanically separated from the electrically conductive separating web; or b) galvanically connected to the second face of the at least one electrically conductive separating web, and extending therefrom in the direction of the fourth face of the at least one filter frame, and ending at a distance from the at least one filter frame or being galvanically separated from the at least one filter frame;

the at least one filter frame being formed integrally together with the at least one separating web and the at least one first and second resonator internal conductors.

3. Coaxial filter according to claim 2, wherein:

the at least one separating web comprises an inaccessible space, which is separated from the receiving space or the first and second receiving chambers.

4. Coaxial filter according to claim 2, wherein:

the at least one separating web:

(a) extends centrally; or (b) passes eccentrically through the at least one filter frame, resulting in the first and second receiving chambers being of different sizes.

5. Coaxial filter according to claim 2 wherein:

the at least one filter frame is produced by casting together with the at least one separating web and the at least one first and second resonator internal conductors.

6. Coaxial filter according to claim 2, wherein:

the at least one separating web is galvanically connected to the second face of the at least one filter frame, the at least one separating web having a smaller height than the at least one filter frame towards the cover arrangement at the transition to the second face of the at least one filter frame, resulting in the opening being formed; or the at least one separating web is spaced apart from the second face of the at least one filter frame, resulting in the opening being formed.

7. Coaxial filter according to claim 2, wherein:

a first coupling-in and/or coupling-out device, which is arranged on the first face of the at least one filter frame and establishes capacitive or inductive or predominantly capacitive or predominantly inductive coupling to the at least one first resonator internal conductor arranged closest to the first face in the first receiving chamber; and/or the coaxial filter further includes at least one second coupling-in and/or coupling-out device, which is arranged on the first face of the at least one filter frame and establishes capacitive or inductive or predominantly capacitive or predominantly inductive coupling to the at least one second resonator internal conductor arranged closest to the first face in the second receiving chamber.

8. Coaxial filter according to claim 7, wherein:

the coaxial filter further includes a third coupling-in and/or coupling-out device, which is arranged on the second face of the at least one filter frame and establishes capacitive or inductive or predominantly capacitive or predominantly inductive coupling to the at least:

i. a first resonator internal conductor arranged in the first receiving chamber closest to the second face; and/or ii. a second resonator internal conductor arranged in the second receiving chamber closest to the second face.

9. Coaxial filter according to claim 2, wherein:

the at least one first resonator internal conductor has a smaller height than the at least one filter frame and/or than the at least one electrically conductive separating web and is spaced apart from the cover arrangement by a first predetermined spacing; and/or the at least one second resonator internal conductor has a smaller height than the at least one filter frame and/or than the at least one electrically conductive separating web and is spaced apart from the cover arrangement by a second predetermined spacing.

10. Coaxial filter according to claim 2, wherein:

a) the at least one first resonator internal conductor is galvanically connected, at the first end thereof, to the third face of the at least one filter frame and/or to the first face of the at least one electrically conductive separating web;

a second end of the at least one first resonator internal conductor, opposing the first end, comprises an extension portion in the direction of the first and/or second face of the at least one filter frame, resulting in the at least one first resonator internal conductor being formed L-shaped or T-shaped in a plan view;

and/or b) the at least one second resonator internal conductor is galvanically connected, at the first end thereof, to the fourth face of the at least one filter frame and/or to the second face of the at least one electrically conductive separating web;

a second end of the at least one second resonator internal conductor, opposing the first end, comprises an extension portion in the direction of the first and/or second face of the at least one filter frame, resulting in the at least one second resonator internal conductor being formed L-shaped or T-shaped in a plan view.

11. Coaxial filter according to claim 10, wherein:

the extension portions of all of the first resonator internal conductors point in the same direction; or the extension portions of all of the second resonator internal conductors point in the same direction; or the extension portion of the at least one first resonator internal conductor points in the same direction as the extension portion of the at least one second resonator internal conductor; or the extension portion of the at least one first resonator internal conductor points in the opposite direction from the extension portion of the at least one second resonator internal conductor.

12. Coaxial filter according to claim 2, wherein:

two adjacent first resonator internal conductors are galvanically interconnected via a first coupling web, the first coupling web having a face facing the at least one filter frame or the at least one separating web, and:

a) being arranged spaced apart from the at least one filter frame and spaced apart from the at least one separating web; or b) being galvanically connected to the at least one filter frame or to the at least one separating web; and/or two adjacent second resonator internal conductors are galvanically interconnected via a second coupling web, the second coupling web having a face facing the at least one filter frame or the at least one separating web, and:

a) being arranged spaced apart from the at least one filter frame and spaced apart from the at least one separating web; or b) being galvanically connected to the at least one filter frame or to the at least one separating web.

13. Coaxial filter according to claim 2, wherein:

at least one first separating screen is arranged between two adjacent first resonator internal conductors so as to reduce the coupling between the two adjacent first resonator internal conductors, the at least one first separating screen being galvanically connected to the third face of the at least one filter frame and/or to the first face of the at least one separating web and protruding into the first receiving chamber by a first particular length; and/or at least one second separating screen is arranged between two adjacent second resonator internal conductors so as to reduce the coupling between the two adjacent second resonator internal conductors, the at least one second separating screen being galvanically connected to the fourth face of the at least one filter frame and/or to the second face of the at least one separating web and protruding into the second receiving chamber by a second particular length.

14. Coaxial filter according to claim 2, wherein:

the coaxial filter comprises several first and/or several second resonator internal conductors including the at least first and second resonator internal conductors; and at least one capacitive and/or inductive coupling is provided between two of the several first and/or second resonator internal conductors which are non-adjacent or not consecutive on a signal transmission path.

15. Coaxial filter according to claim 14, wherein:

the at least one capacitive and/or inductive coupling is arranged between two of the several first and/or two second resonator internal conductors in a common one of the first and second receiving chambers;

or the at least one capacitive and/or inductive coupling is arranged between two of the several first and/or second resonator internal conductors in two different ones of the first and second receiving chambers.

16. Coaxial filter according to claim 14, wherein:

the inductive coupling is formed by a coupling rod, which is galvanically connected to the at least first and second resonator internal conductors and extends between the at least first and second resonator internal conductors and the cover arrangement;

the coupling rod extends:

a) exclusively in the first receiving chamber; or b) exclusively in the second receiving chamber; or c) from the first receiving chamber, via the opening or via a further recess in the at least one separating web, into the second receiving chamber.

17. Coaxial filter according to claim 14, wherein:

the capacitive coupling is formed by a coupling element which comprises at least two interconnected capacitive coupling faces, each of these capacitive coupling faces being arranged spaced apart between one of the at least first and second resonator internal conductors and the cover arrangement;

the coupling element is galvanically separated from the at least first and second resonator internal conductors, the at least one separating web and the at least one filter frame; and the coupling element extends:

a) exclusively in the first receiving chamber; or b) exclusively in the second receiving chamber; or c) from the first receiving chamber, via the opening or via a further recess in the at least one separating web, into the second receiving chamber.

18. Coaxial filter according to claim 2, wherein:

the coaxial filter further comprises an outer filter frame;

the coaxial filter comprises n separate filter frames including the at least one filter frame, where $n \geq 2$, of the at least first and second resonator internal conductors comprising plural first resonator internal conductors and plural second resonator conductors being formed in each filter frame;

the n filter frames are arranged one above another;

the cover arrangement closes off the outer filter frame;

the cover arrangement comprises at least $n-1$ intermediate covers;

at least one of the $n-1$ intermediate covers is arranged between every two filter frames;

the $n-1$ intermediate covers comprise at least one coupling opening, resulting in coupling being provided between first and/or second resonator internal conductors of different filter frames.

19. Coaxial filter according to claim 18, wherein:

the at least one electrically conductive separating web comprises first and second resonator internal conductors formed in each filter frame.

20. Coaxial filter according to claim 2, wherein:

the coaxial filter also comprises m further separating webs, where $m \geq 1$, which subdivide the receiving space into m further receiving chambers, the m further receiving chambers each comprising at least one further resonator internal conductor, and the m further separating webs a) being galvanically conductively connected to the at least one filter frame at the first face thereof, and protruding into the receiving space, and extending in the direction of the second face where the second face ends so as to form an opening therewith; or b) being galvanically conductively connected alternately to the first and second face of the at least one filter frame, resulting in the individual receiving chambers being interconnected in a meander shape;

wherein the at least one separating web and the m further separating webs are separated from each other.

* * * * *